US008590893B2

(12) United States Patent
Monopoli

(10) Patent No.: US 8,590,893 B2
(45) Date of Patent: Nov. 26, 2013

(54) WHEEL GAME WITH HOLES

(75) Inventor: Donald Monopoli, Melbourne, FL (US)

(73) Assignee: Don Monopoli Productions, Inc., Melbourne, FL (US)

( * ) Notice: Subject to any disclaimer, the term of this patent is extended or adjusted under 35 U.S.C. 154(b) by 27 days.

(21) Appl. No.: 13/463,992

(22) Filed: May 4, 2012

(65) Prior Publication Data

US 2012/0292851 A1 Nov. 22, 2012

Related U.S. Application Data

(60) Provisional application No. 61/519,063, filed on May 16, 2011.

(51) Int. Cl.
*A63F 7/00* (2006.01)

(52) U.S. Cl.
USPC ..... 273/108; 273/118 R; 273/129 R; 273/127 R; 273/127 B

(58) Field of Classification Search
USPC ..... 273/126 R, 108, 118 R, 119 R, 127 R, 273/127 B, 127 D
See application file for complete search history.

(56) References Cited

U.S. PATENT DOCUMENTS

| | | | | |
|---|---|---|---|---|
| 607,020 | A | | 7/1898 | Dodge |
| 742,416 | A | | 10/1903 | Hall |
| 922,717 | A | | 5/1909 | Parker |
| 945,286 | A | | 1/1910 | Rumpf |
| 1,262,314 | A | | 4/1918 | Downey |
| 1,545,329 | A | | 7/1925 | Johnston |
| 1,561,934 | A | | 11/1925 | Kennedy |
| 1,604,846 | A | | 10/1926 | Nelson |
| 2,456,322 | A | * | 12/1948 | Richardson ..... 473/185 |
| 2,473,680 | A | * | 6/1949 | Farris ..... 473/184 |
| 2,662,518 | A | * | 12/1953 | Luthi ..... 124/17 |
| 3,033,570 | A | * | 5/1962 | Mathes et al. ..... 273/126 R |
| 3,132,864 | A | * | 5/1964 | Glass et al. ..... 273/127 R |
| 3,135,514 | A | * | 6/1964 | Ahrent ..... 473/410 |
| 3,386,737 | A | | 6/1968 | Burgess |
| 3,628,793 | A | | 12/1971 | Mudloff |
| 3,807,738 | A | * | 4/1974 | Breslow ..... 273/126 R |
| 3,837,653 | A | | 9/1974 | Fox |
| 3,861,524 | A | | 1/1975 | Coleman |
| 4,019,739 | A | * | 4/1977 | Waite ..... 273/352 |
| 4,040,626 | A | * | 8/1977 | Sterlicchi et al. ..... 273/123 R |
| 4,516,775 | A | | 5/1985 | Suarez |
| 4,726,591 | A | | 2/1988 | Johnson |
| 4,974,858 | A | | 12/1990 | Knowlton |

(Continued)

OTHER PUBLICATIONS

PCT Search Report, PCT/US12/36592, 10 pages.

*Primary Examiner* — Raleigh W Chiu
(74) *Attorney, Agent, or Firm* — Brian S. Steinberger; Law Offices of Brian S. Steinberger, P.A.

(57) ABSTRACT

Outdoor and indoor rolling games, game box stations ramps and methods of play where one or more participants physically rolls wheels towards a ramp which leads to a box, and a target area, such as circular hole or rectangular hole where player(s) accumulate points under selected playing rules. A station box can have a fold down ramp with an optional opening in the back of the box. Another station can have wheels and cooler in a hand truck arrangement. Another version can use a foldable ramp with removable inserts that allows the game to also be used with bean bags.

17 Claims, 25 Drawing Sheets

(56) References Cited

U.S. PATENT DOCUMENTS

| | | | | |
|---|---|---|---|---|
| 5,056,796 | A | 10/1991 | Conville | |
| 5,199,708 | A | 4/1993 | Lucas | |
| 5,553,862 | A | 9/1996 | Konotopsky | |
| 5,664,776 | A | 9/1997 | Mateer | |
| 6,244,598 | B1 | 6/2001 | Conville | |
| 6,866,268 | B2 | 3/2005 | Christianson | |
| 7,168,702 | B1 | 1/2007 | Shoemaker | |
| 7,607,666 | B1 | 10/2009 | Studier | |
| 2006/0065665 | A1 | 3/2006 | Swartfager | |
| 2012/0292851 | A1* | 11/2012 | Monopoli | 273/126 R |

* cited by examiner

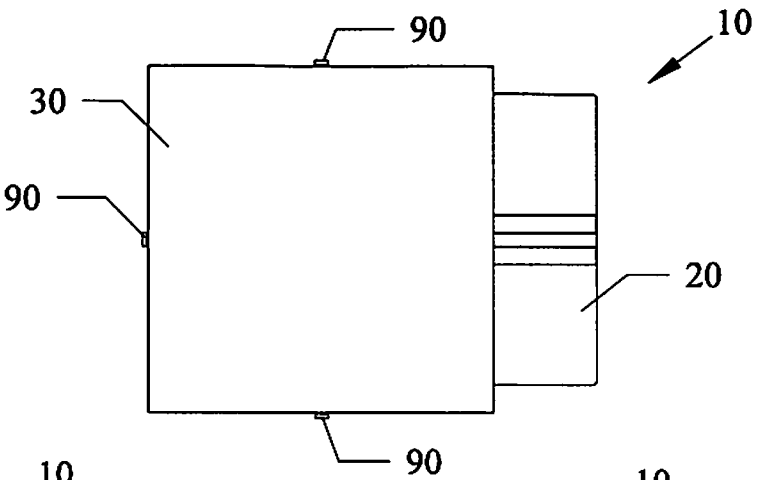
FIG. 1
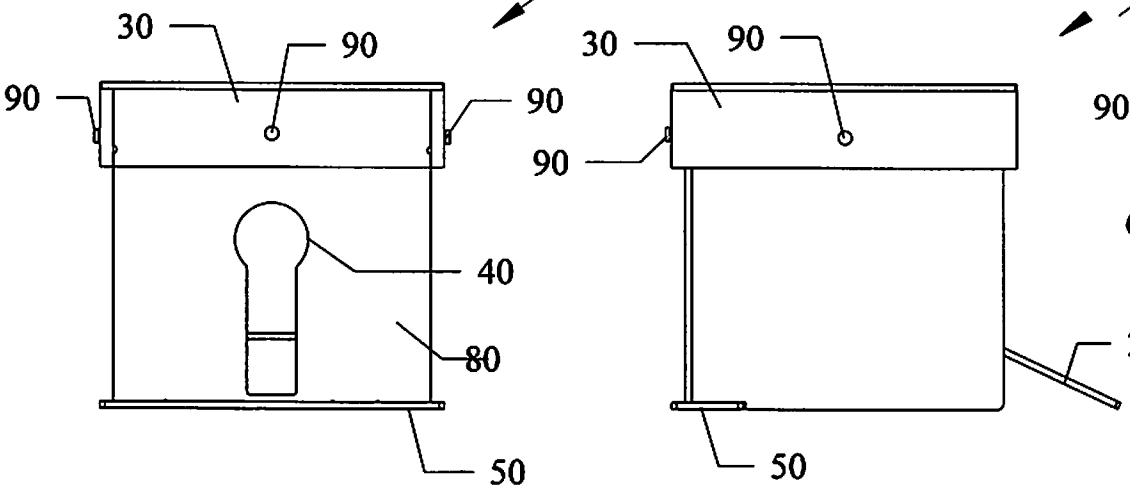
FIG. 2
FIG. 3
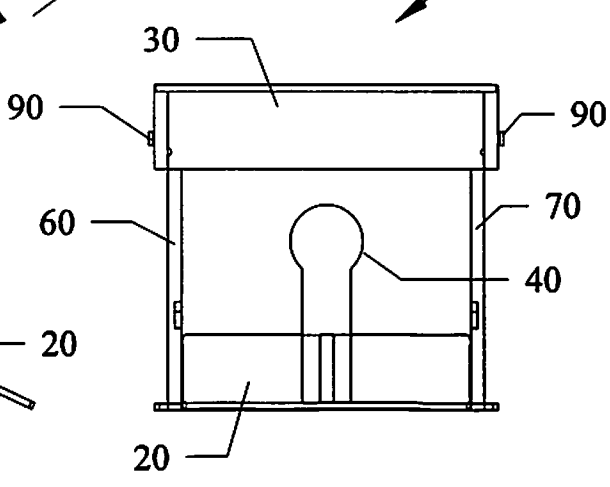
FIG. 4

WHEEL GAME WITH HOLES

CROSS REFERENCE TO RELATED APPLICATIONS

This invention claims the benefit of priority to U.S. Provisional Application Ser. No. 61/519,063 filed May 16, 2011.

FIELD OF INVENTION

This invention relates to outdoor and indoor rolling games, and particular to games, stations, ramps and methods of play where one or more participants physically rolls wheels towards a ramp which leads to a box, and a target area, such as circular hole or rectangular hole where player(s) accumulate points under selected playing rules.

BACKGROUND AND PRIOR ART

Various types of yard games, activities and sports, such as horseshoes, lawn darts, bowling and toss games have become popular because of the social aspects, the physical activity, and inclusiveness of different age, gender and ability to compete.

For example, beanbag, sandbag and disc tossing type games have been used many times over the years. See for example, U.S. Pat. Nos. 922,717 to Parker; 3,628,793 to Mudloff; 4,726,591 to Johnson; 4,974,858 to Knowlton; 5,056,796 to Conville; 5,553,862 to Konotopsky; 6,866,268 to Christianson; and 7,607,666 to Studier.

Other types of games, such a ball rolling games have been proposed. See for example, U.S. Pat. Nos. 607,020 to Dodge; 742,416 to Hall; 945,286 to Rumpf; 1,262,314 to Downey; 1,545,329 to Johnston Jr.; 1,561,934 to Kennedy; 1,604,846 to Nelson; 3,837,653 to Fox et al.; and 4,726,591 to Johnson.

Some games have attempted to use rollable rings and discs. See for example, U.S. Pat. Nos. 2,662,518 to Luthi; 3,386,737 to Burgess; 5,199,708 to Lucas; and 5,664,776 to Mateer.

While these games may be suitable for the particular purpose to which they address, they are not the same and would not be suitable for all the purposes of the present invention as hereto described.

SUMMARY OF THE INVENTION

A primary objective of the present invention is to provide games, stations, ramps and method of play where one or more participants physically rolls wheels towards a ramp which leads to a box, and a target area, such as circular hole or rectangular hole where player(s) accumulate points under selected playing rules.

A secondary objective of the present invention is to provide a self-contained game assembly that can be assembled from a wheeled box, and where one or more participants physically rolls the wheels that are used for the transportable box towards a ramp which leads to a box, and a target area, such as circular hole or rectangular hole.

A third objective of the present invention is to provide a wheeled box that can serve as both a sitting stool for a participant and for a game that can be assembled from a wheeled box, and where participants physically rolls the wheels from the box towards a ramp which leads to a box, and a target area, such as circular hole or rectangular hole.

A fourth objective of the present invention is to provide a physical wheel rolling game for one or more participants, intended for a large playing area outside or inside if the room permits, where the participants roll wheels into a target assembly to garner points in competition.

A fifth objective of the present invention is to provide a physical wheel rolling game for one or more participants, having a target area that can be interchanged overtime.

The game can be comprised of one or two portable box units, each unit having two wheels that can be removed for play. The box can have a fold down side that can double as a ramp for play, where wheels from the box can be used by players to roll up the ramp and toward a target area such as circular hole or rectangular hole.

The box unit or two box units can be collapsed into components that can be carried in a single suitcase.

Another box version can have extendable handles, and wheels on two lower corners of the box, to allow the box to be moved similar to a hand truck. The wheeled box unit can have a hinged upper lid/cover that can access a space that can be used as cooler. Slots in the handle and/or on the box can be used for scoring. Removable pegs can be inserted and moved along the series of holes to update player scores.

Another version of the game can have a ramp and back panel that are foldable with one another, along with a slot in the ramp. An additional slot can be placed in the rear panel to add difficulty to game play.

Further objects and advantages of this invention will be apparent from the following detailed description of the presently preferred embodiments which are illustrated schematically in the accompanying drawings.

BRIEF DESCRIPTION OF THE FIGURES

FIG. 1 is a top view of the wheel game with holes station and folding ramp.

FIG. 2 is a rear view of the station of FIG. 1.

FIG. 3 is a side view of the station of FIG. 1.

FIG. 4 is a front view of the station of FIG. 1.

DESCRIPTION OF THE PREFERRED EMBODIMENTS

Figure 6:
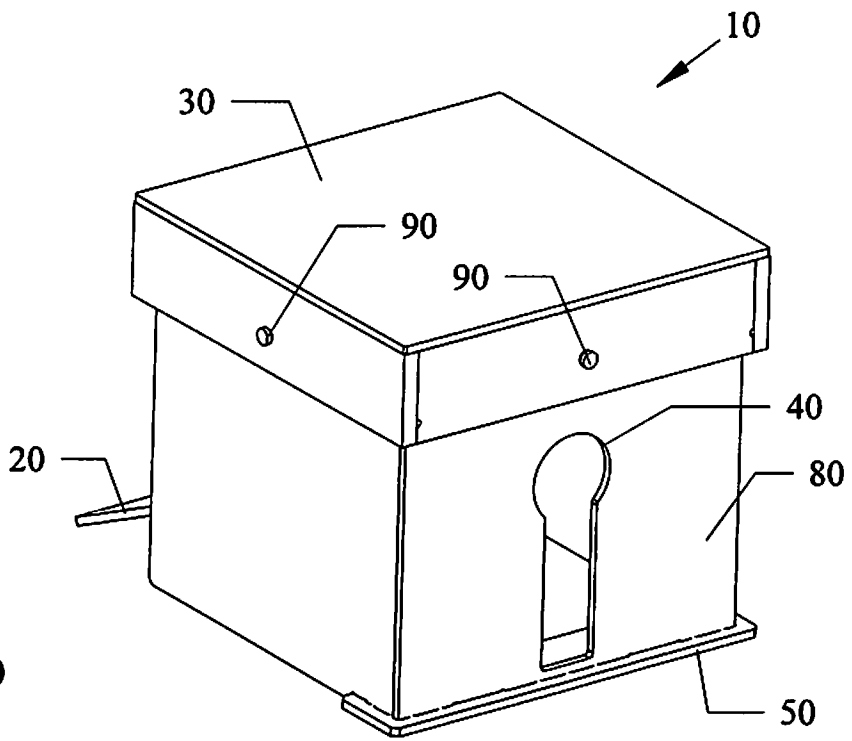
FIG. 6 is a rear perspective view of the station of FIG. 1.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A listing of components will now be described.

10. Folding Wheel Hole station.
20. Station ramp.
22. extension pins to pivot ramp 20
29. track
30. Station cap and half of carrying case.
40. Keyhole in back of station for extra scoring potential.
50. Stiffening brace.
52. end slots
54. side slots
56. middle slot
60. Left side.
61. fastening hole
62. notched bottom edge
65. angled cut-out groove
70. Right side.
71. fastening hole
72. notched bottom edge
75. angled cut-out groove
80. Rear panel.
81. fastening hole
84. notched bottom edges
86. notched middle edge
90. Thumb screw for assembling station.
100. Wheel.
105. tire
110. Wheel path into station.
120. Wheel path out of station should the wheel go through the keyhole in the back panel.
130. Two disassembled complete Wheel Hole stations along with four wheels for playing the game stacked for packaging into carrying case.
140. Handle for assembled carrying case.
150. Backing plate with threaded inserts for assembling carrying case.
160. Threaded insert in station cap for handle assembly.
170. Components for two Wheel Hole stations (less station caps) and four wheels for playing the game stacked for packaging (less station caps).
180. Complete Wheel Hole game packed and ready to carry.
190. Optional hub plate for wheel (female connector). The connector could be screw fit, press fit, or snap fit. Two plates can be used per wheel; male and female.
200. Optional hub plate for wheel (male connector). The connector would match the female hub plate configuration (screw, press, or snap fit).
210. Male connector on hub plate.
220. Female connector on hub plate.
230. Hole in wheel through which the hub connectors pass to mate and secure the plates to the wheel.
240. Optional scoring peg.
250. Optional holes in station cap for scoring peg progression.
260. Rolling mobile Wheel Hole station. Top portion incorporates a ice cooler. Two stations can play game.
265. rectangular upright box
270 Fold down ramp.
272. track indicia on ramp
275. hinge
278. fastening edge of ramp
280. Extendable handle incorporates optional scoring holes to house scoring pegs.
290. U-brackets secure extendable handle to body of station.
300. Hinged cooler cover/lid doubles as a seat.
310. Optional holes in handle for scoring peg progression.
320. Lift handle on back of station.
330. Cooler cover hinge.
340. Rolling wheel for station mobility.
350. Folding foot.
360. Keyhole in back of mobile station for extra scoring potential.
370. Ice cooler incorporated into top of station.
380. Lower cavity of station receives wheel when "pitched".
390. Portable folding ramp version of Wheel Hole game.

400. Main ramp with hole target for wheel.
402. track indicia
410. Hinged support panel tilts ramp up for play.
420. Hole in main ramp for wheel target.
430. Recess ledge in ramp hole accepts insert to convert game to popular Corn Hole bean bag game
440. Keyhole cut out in support panel offers extra scoring potential.
450. Hinge for support panel.
460. Wheel path onto and up ramp toward target hole.
470. Corn hole conversion insert fits into Wheel Hole target hole and rests on ledge in hole.
480. Bean bag target hole in insert.
490. Bean bag is thrown into target hole in insert.
500. Path of bean bag into target hole in insert.
510. Thread-on wheel retaining cap. This could be a wing nut or any style of hand tightened fastener.
520. Threaded wheel axle.
530. Foot axle upon which fold-up foot rotates to fold up and out of the way for play.

Wheel Hole Station and Carrying Case

Figure 5:
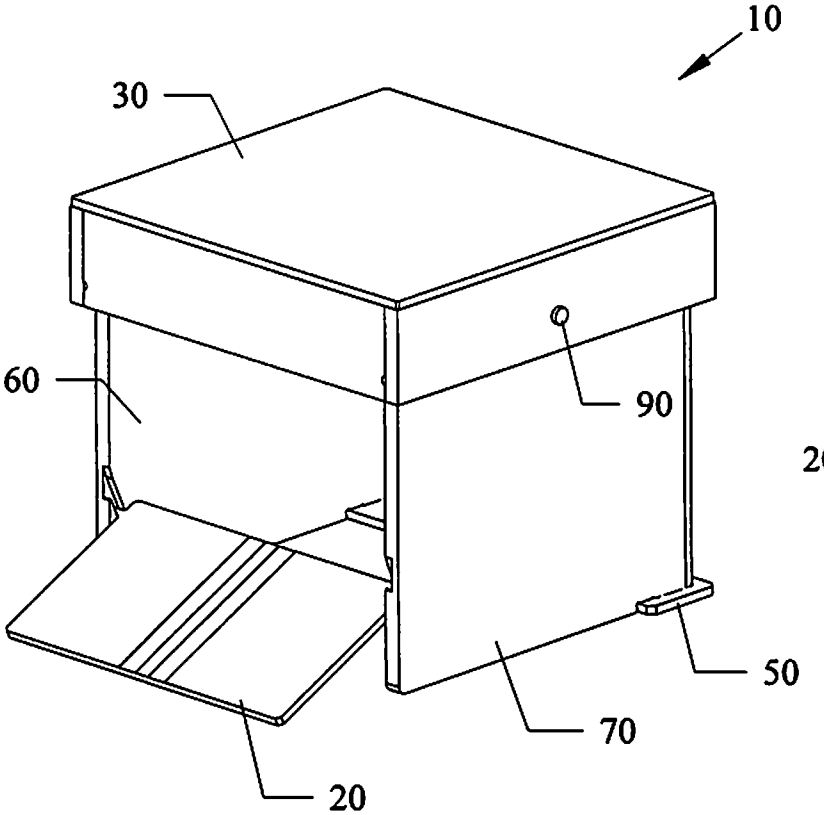
FIG. 5 is a front perspective view of the station of FIG. 1.

FIG. 1 is a top view of the wheel game with holes station 10 and folding ramp 20. FIG. 2 is a rear view of the station 10 of FIG. 1. FIG. 3 is a side view of the station 10 of FIG. 1. FIG. 4 is a front view of the station 10 of FIG. 1. FIG. 5 is a front perspective view of the station 10 of FIG. 1. FIG. 6 is a rear perspective view of the station 10 of FIG. 1.

Referring to FIGS. 1-7, the wheel game with holes station 10 is shown assembled. The station 10 can include a box configuration having a station cap 30 which also can function as half of a carrying case, left side 60, right side 70, rear panel 80. The station can further include a keyhole shaped slot 40 in back of the station for extra storing potential. Additionally, a stiffening brace 50 can be used for supporting the left and right sides 60, 70 and rear panel 80. On opposite sides of the cap 30 can be fasteners 90, such as thumbscrews for fastening the cap 30 to fastening holes in the sides 60, 70 and panel 80.

Figure 7:
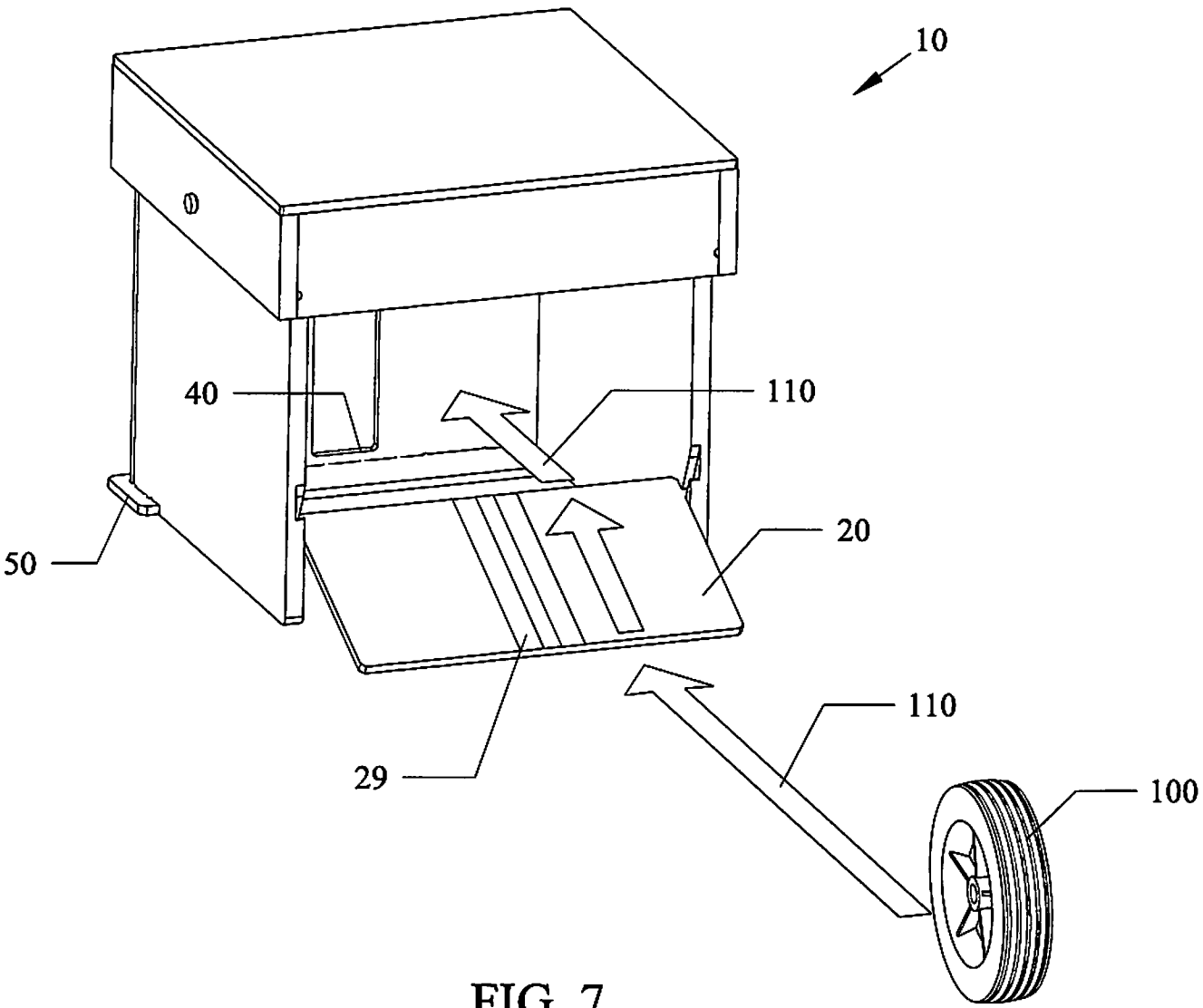
FIG. 7 is a front perspective view of the station of FIG. 1 showing a wheel being rolled up the ramp and into box.
Figure 8:
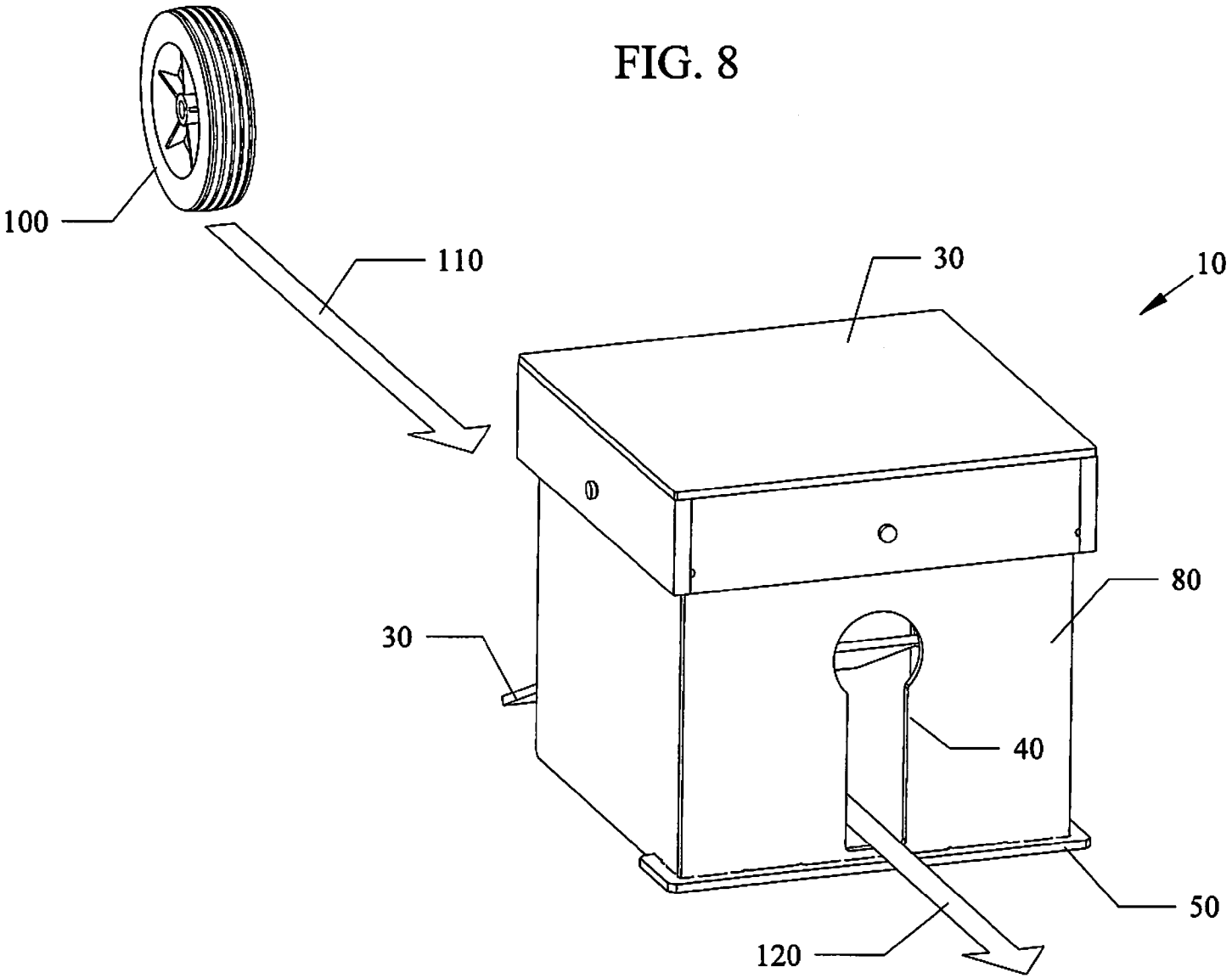
FIG. 8 is a rear perspective of the station of FIG. 7 showing the wheel being rolled into box and through the keyhole cutout in the back panel for extra point(s).

FIG. 7 is a front perspective view of the station 10 of FIG. 1 showing a wheel 100 being rolled up the folded down ramp 20 along a path 110 and into box of the station 10. Indicia 29, such as track lines can be formed on the ramp 20 to aid the user in aiming into the box station 10. FIG. 8 is a rear perspective of the station 100 of FIG. 7 showing the wheel 100 being rolled into the box station 10 and through the keyhole cutout 40 in the back panel 80 and out 120 for extra point(s).

Figure 9:
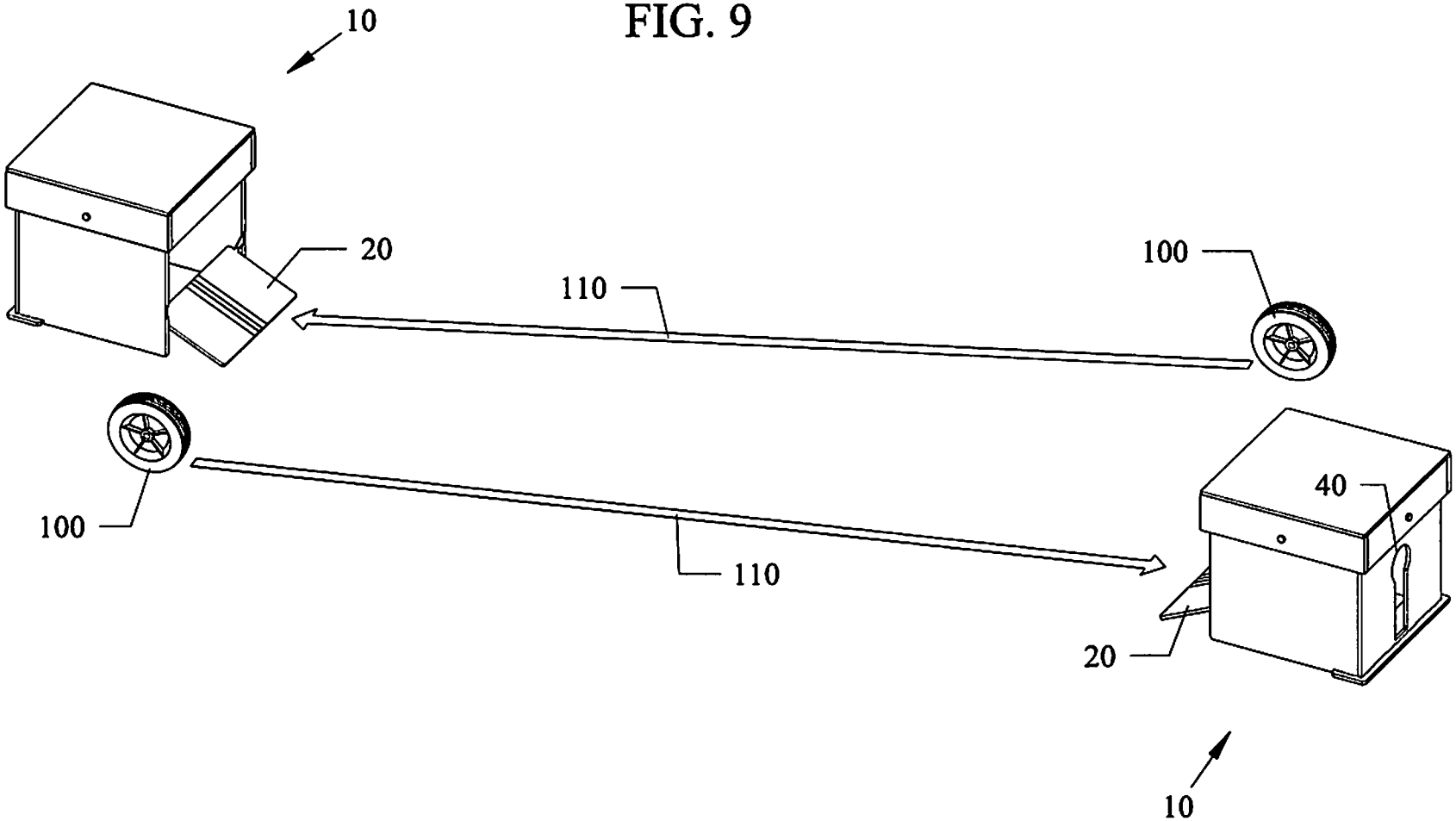
FIG. 9 is a perspective view of a play setup with two stations with wheel paths toward the stations.

FIG. 9 is a perspective view of a play setup with two stations 10 with wheel paths 110 toward the stations 10. The covers 30 on each station 10 can also function as seats for the players, so that the players can play or rest in seating positions.

Figure 10:
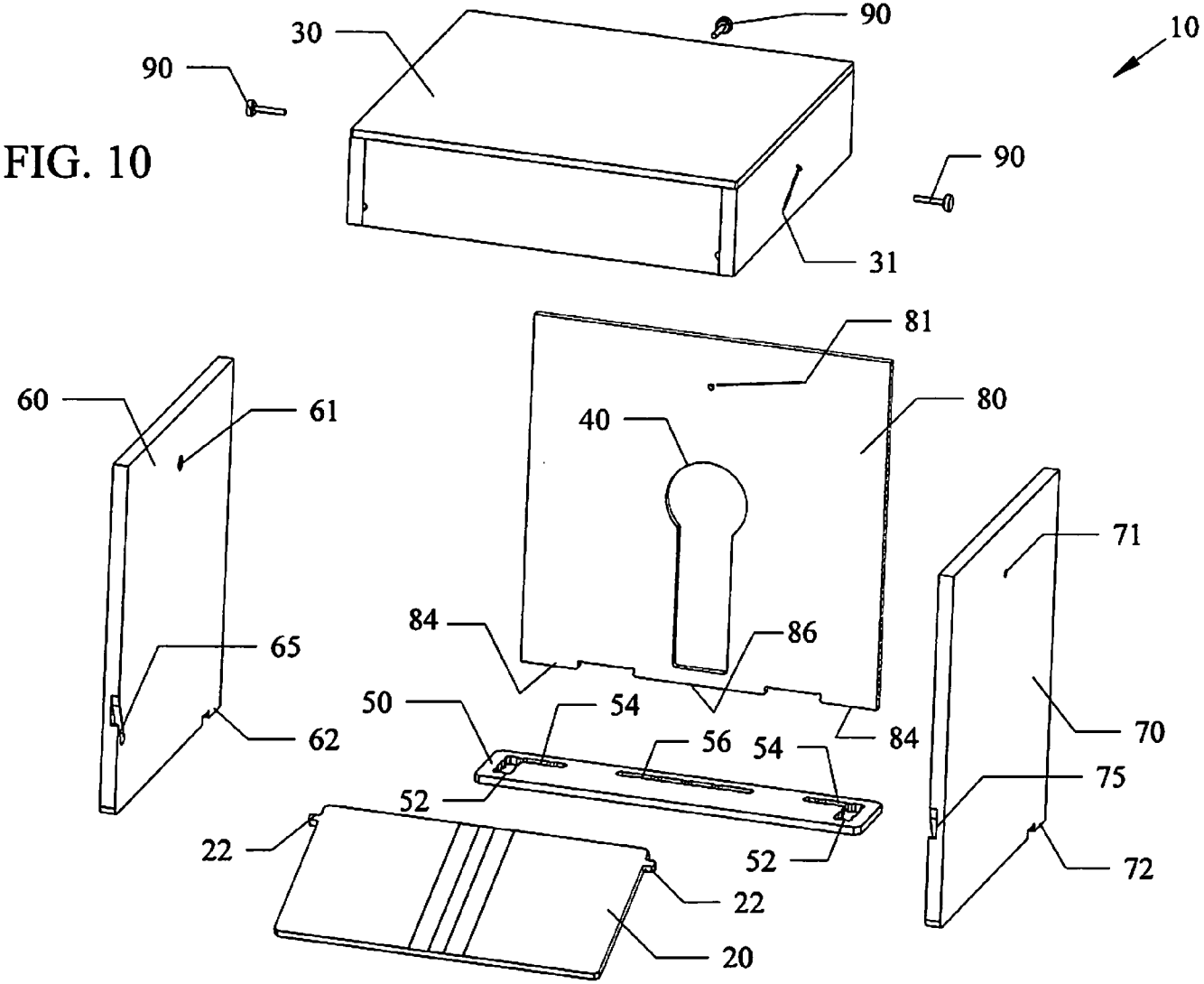
FIG. 10 is an exploded view of the station of FIG. 1 disassembled for storage into carrying case.

FIG. 10 is an exploded view of the station 10 of FIG. 1 disassembled for storage into carrying case 180 to be described later. Referring to FIGS. 1-7 and 10, the user can place stiffening brace 50 on the ground in order to mount the sides 60, 70 and rear panel 80.

Notched bottom edges 62 and 72 on the bottom rear corners of sides 60, 70 can be pressed into mating slots 52 on opposite ends of the brace 50 and snapped (or friction fitted) into place. Notched bottom corner edges 84 of rear panel 80 can be pressed into respective slots 54 on brace 50 and also and snapped (or friction fitted) into place. And central notched bottom edge 86 of rear panel 80 can be pressed into mating middle slot 56 of brace 50 and snapped (or friction fitted) into place.

Next, the rear extension pins 22 can be slid down into inwardly facing angled cut-out grooves 65, 75 of the sides 60, 70, so that the ramp 20 can pivot relative to the sides 60, 70.

Finally, the cap cover 30 can be fit over the tops of sides 60, 70 and rear panel 80, and fasteners 90, such as thumb screws, can attach through side hole(s) 31(only one is shown) of the cap 30 into mating fastener holes 61, 71, 81 of the sides 60, 70 and rear panel 80.

Figure 11:
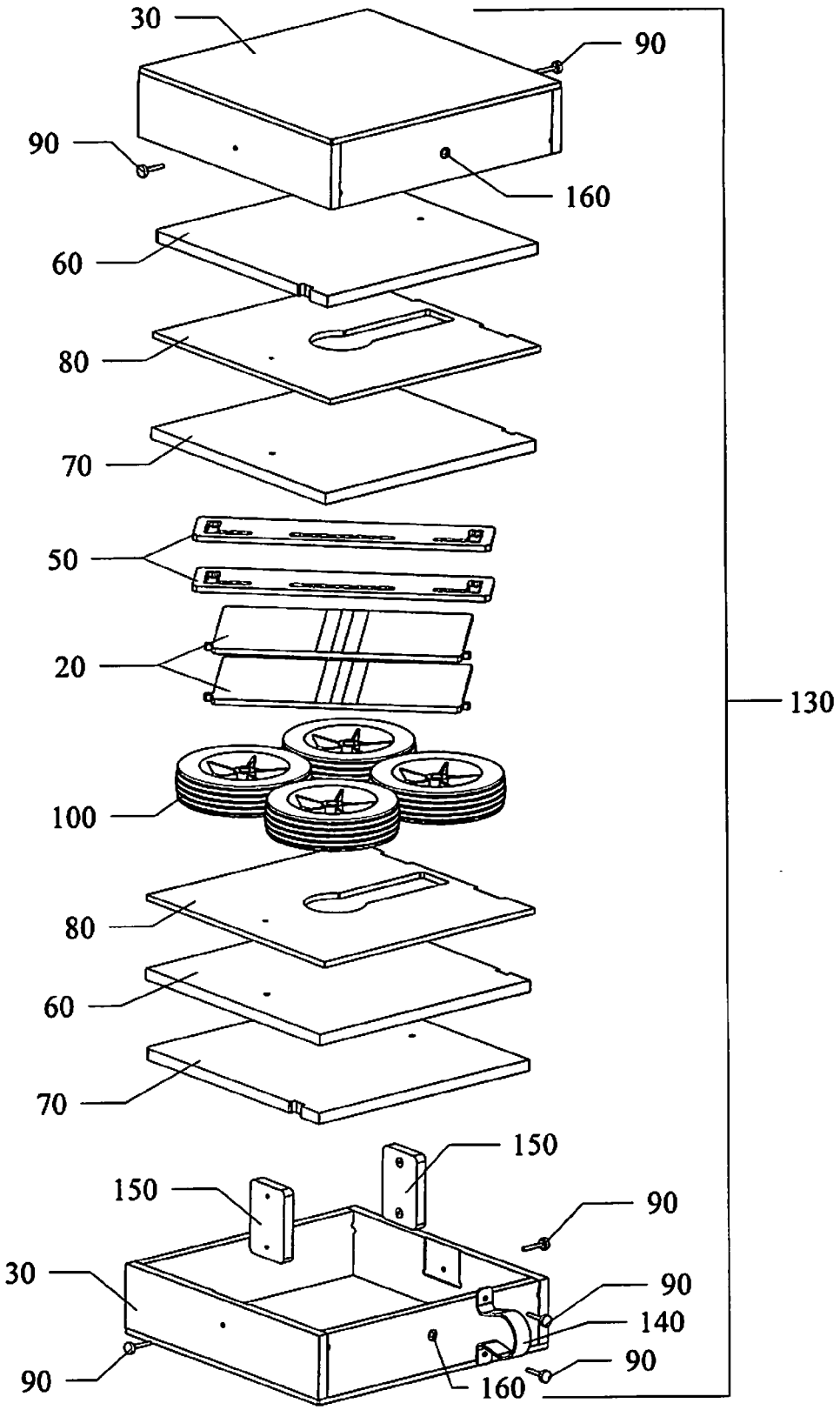
FIG. 11 is an exploded view of all components for two wheel stations along with 4 wheels for game play oriented for storage into the two stations caps which serve as part of the carrying case.
Figure 14:
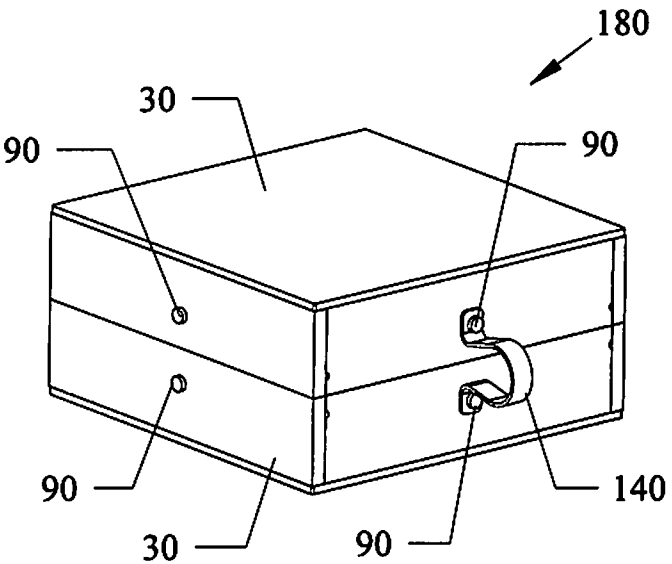
FIG. 14 is a perspective view of FIG. 13 with the upper station cap in place and thumb screws used to secure station caps to each other.

FIG. 11 is an exploded view of all components 130 for two wheel stations 10 along with 4 wheels 100 for game play oriented for storage into the two stations caps 30 which serve as part of the carrying case 180(shown in FIG. 14. A handle 140 can have one end attached the lower cap 30 by fastener 90(such as a thumbscrew) that attaches to a threaded insert 160 in the cap 30.

Figure 12:
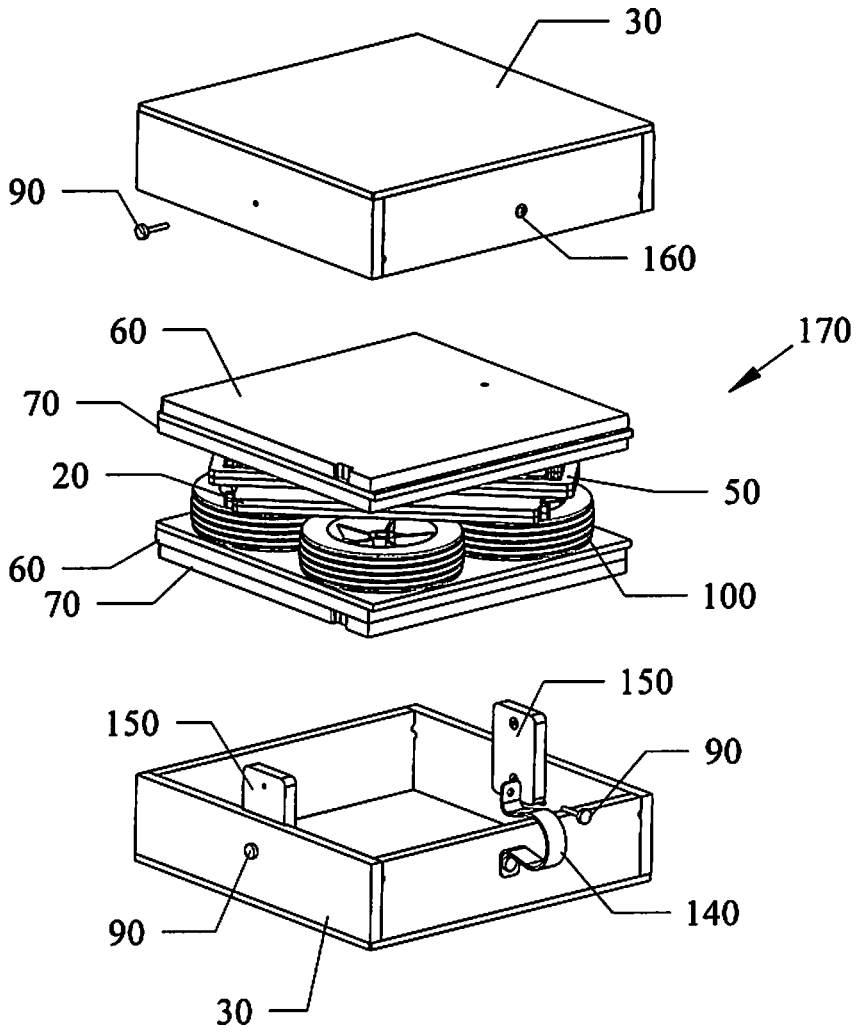
FIG. 12 is a perspective view of the components in FIG. 11 stacked for storage.

FIG. 12 is a perspective view of the components in FIG. 11 stacked 170 for storage between caps 30 with backing plates 150 attached to inner side edges of lower cap 30 by fasteners 90.

Figure 13:
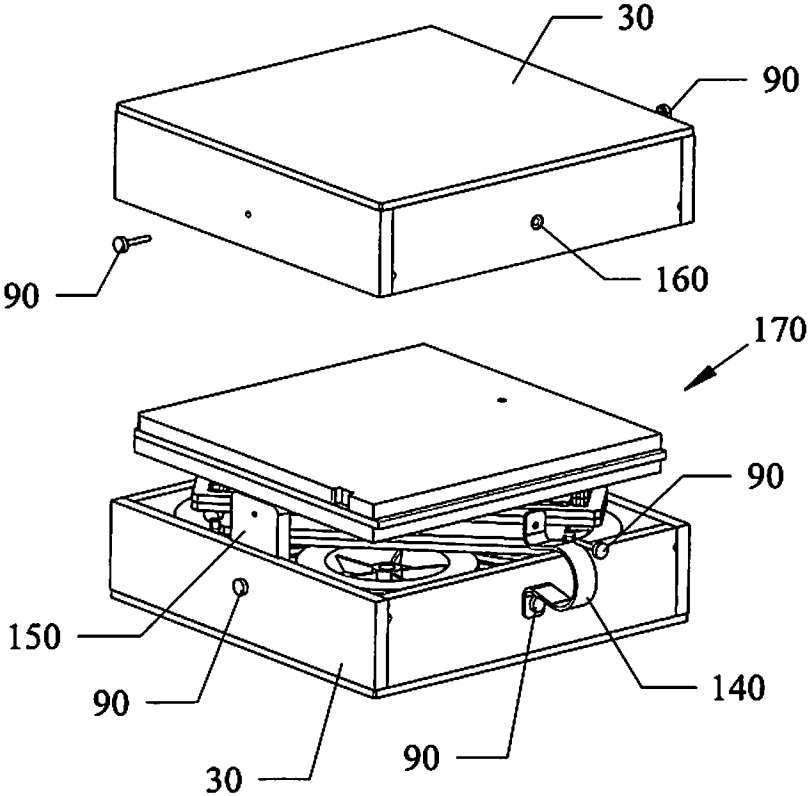
FIG. 13 shows the stacked components of FIG. 12 placed in a lower station cap for storage.
Figure 16:
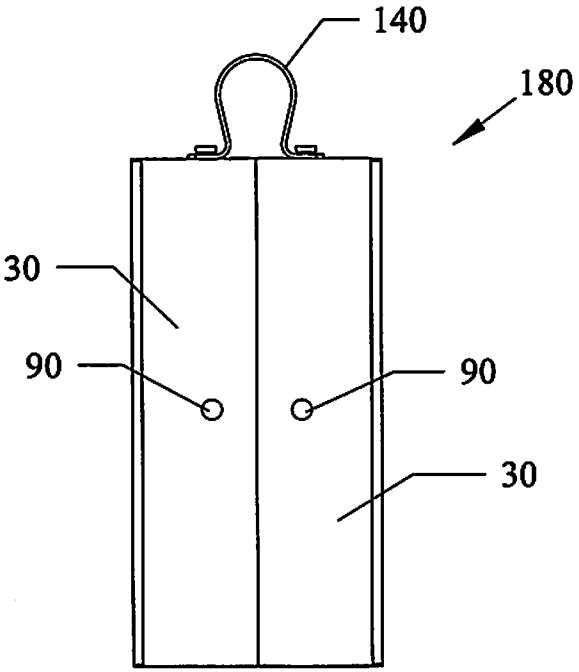
FIG. 16 is a side view of the game station case of FIG. 15.
Figure 15:
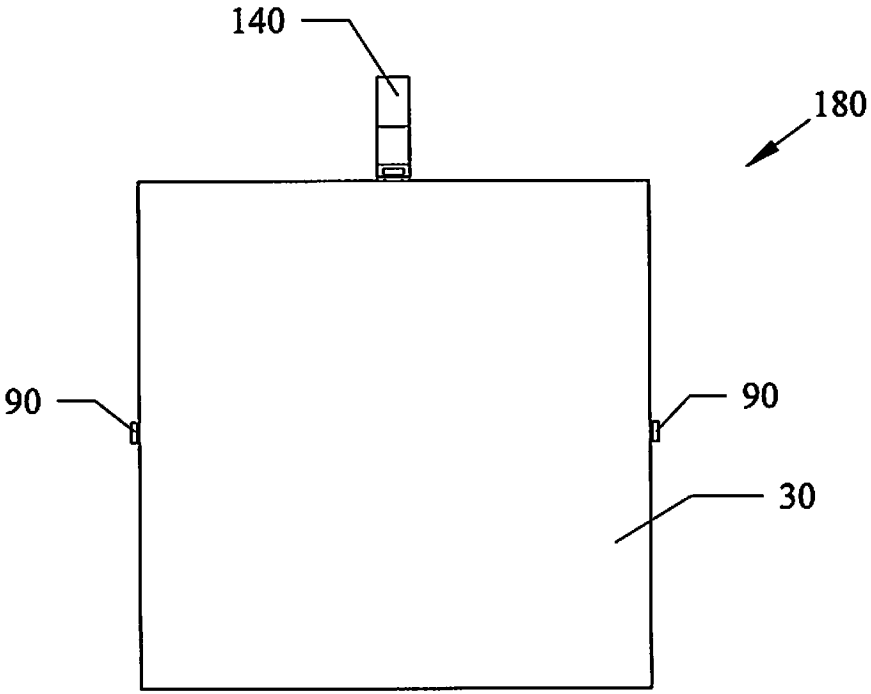
FIG. 15 is a front view of the assembled game station case of FIG. 14.

FIG. 13 shows the stacked components 170 of FIG. 12 placed in a lower station cap 30 for storage. FIG. 14 is a perspective view of FIG. 13 with the upper station cap 30 in place and thumb screws 90 used to secure each of the station caps 30 to each other to be used as a carrying case 180. The top end of handle 140 is similarly attached to the side of upper cap 30 by another fastener 90, such as a thumbscrew. FIG. 15 is a front view of the assembled game station case 180 of FIG. 14. FIG. 16 is a side view of the game station case 180 of FIG. 15.

Figure 18:
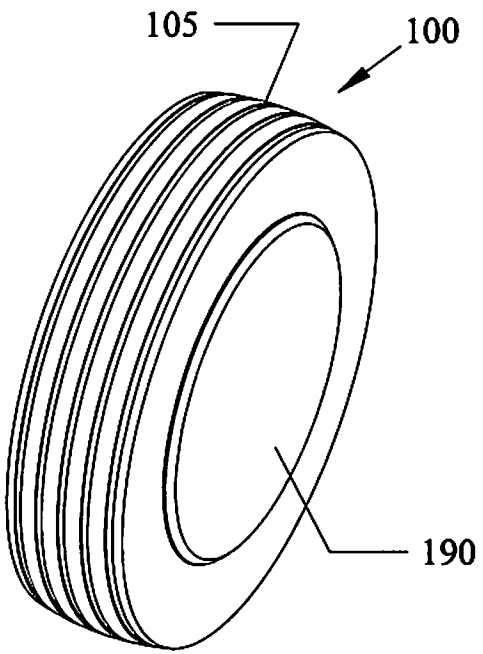
FIG. 18 is a perspective view with hub plates assembled. The plates can be used for logo or advertising information or just to dress up the wheel.
Figure 17:
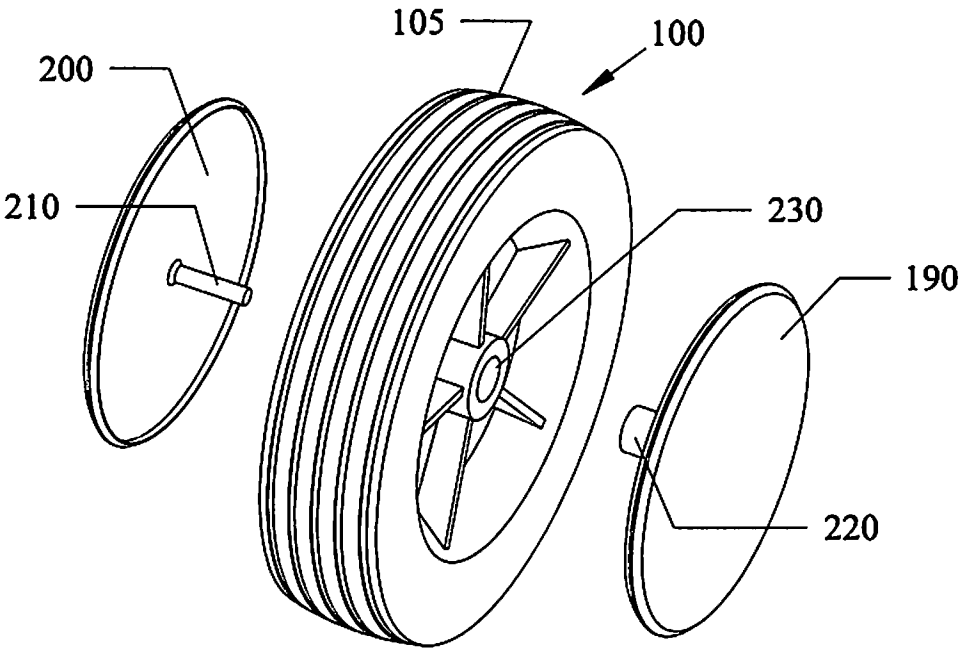
FIG. 17 is a perspective view of an optional wheel of the game stations of FIG. 11-12 for play with hub plates positioned for assembly.
Figure 20:
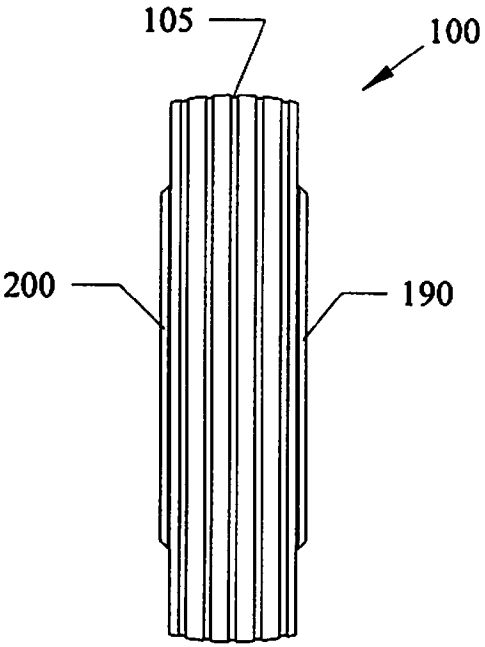
FIG. 20 is a side view of wheel with the hub plates assembled of FIG. 19.
Figure 21:
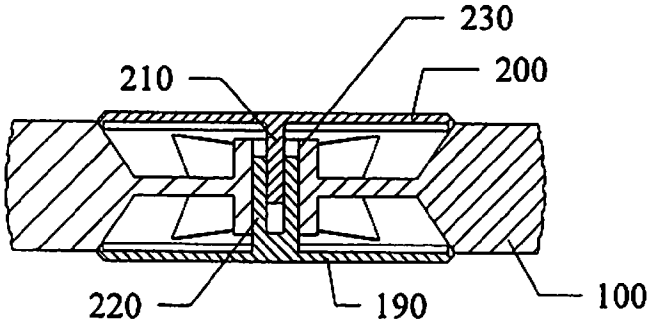
FIG. 21 is a cross-sectional view of the wheel with hub plates assembled of FIG. 19 along arrow 21Y.
Figure 19:
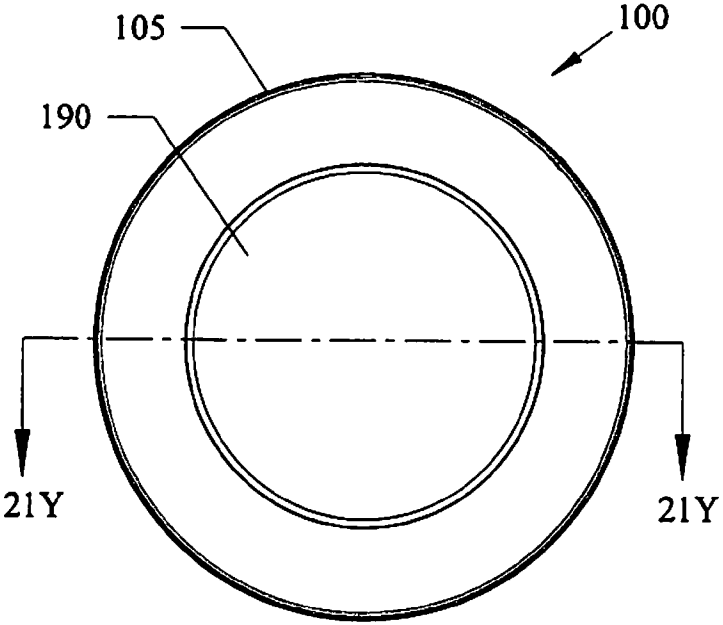
FIG. 19 is a front view of FIG. 18 with the wheel and hub plates assembled.

FIG. 17 is a perspective view of an optional wheel 100 having tire 105 about a rim of the game station components 130 of FIG. 11-12 for play with hub plates 190, 200 positioned for assembly. The tire 105 can be formed from material such as but not limited to rubber, plastic, compositions, wood, and the like. Male connector 210 on hub plate 200 can pass through hole 230 in wheel 100 and snap into female receptacle 220 in opposite hub plate 190. FIG. 18 is a perspective view with hub plates 190, 200 assembled on the wheel 100. The plates can be used for logo or advertising information or just to dress up the wheel 100. FIG. 19 is a front view of FIG. 18 with the wheel 100 and hub plates 190, 200 assembled. FIG. 20 is a side view of wheel 100 with hub plates 190, 200 assembled of FIG. 19. FIG. 21 is a cross-sectional view of the wheel with hub plates assembled of FIG. 19 along arrow 21Y.

Figure 22:
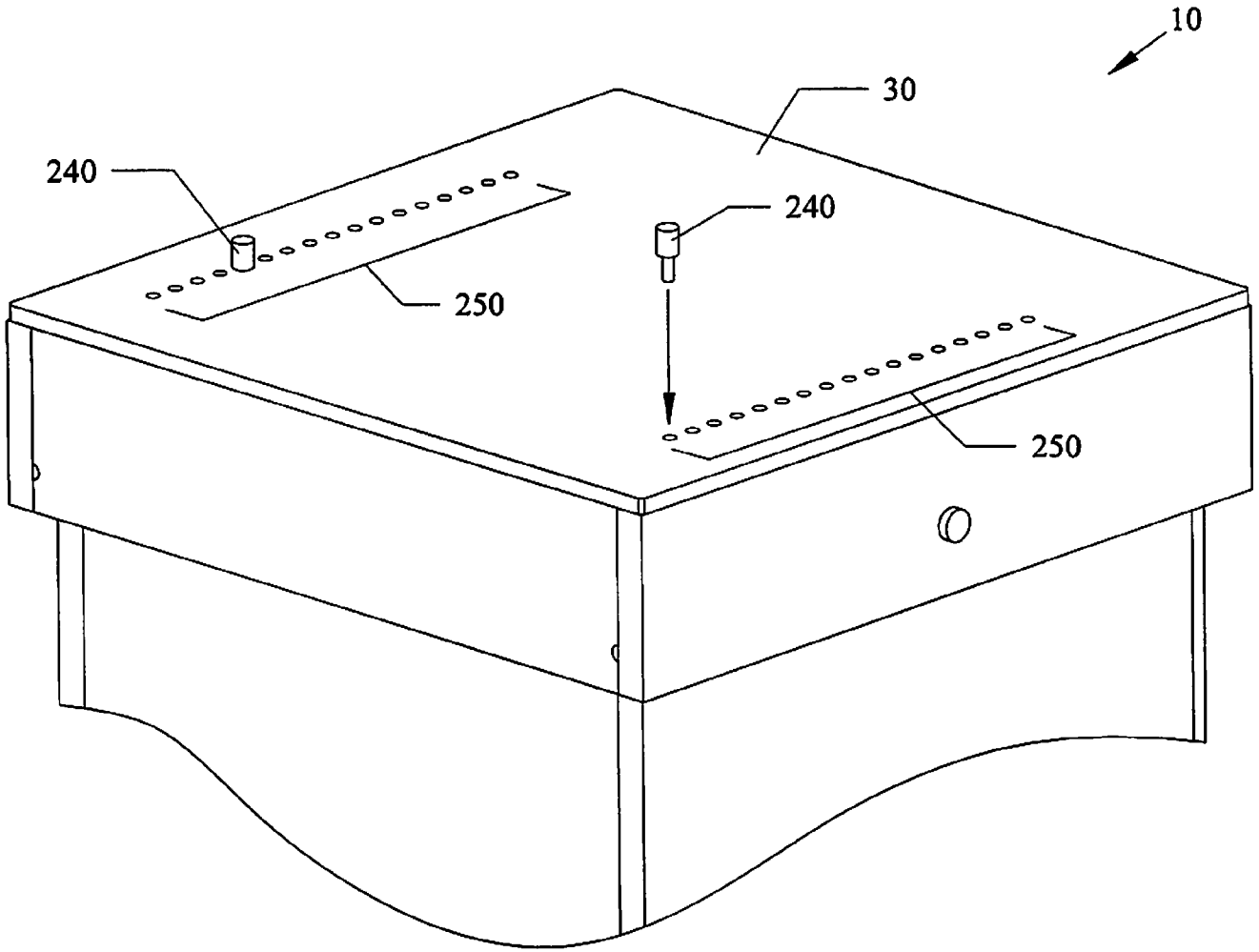
FIG. 22 is a top perspective view of the wheel station box of FIGS. 1-9 with optional holes and pegs for scoring.

FIG. 22 is a top perspective view of the wheel station 10 of FIGS. 1-9 with optional holes 250 and pegs 240 on the cap 30 for scoring. The player(s) can move the peg(s) 240 to the right or to the left to show the progression of scoring.

Portable Wheel Station for Wheel Game

Figure 24:
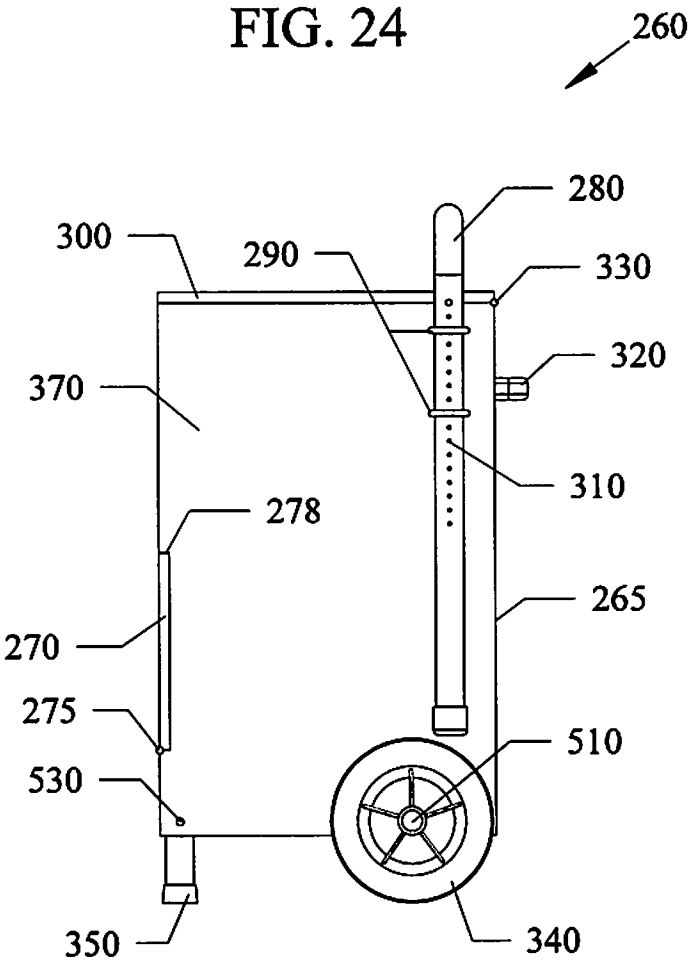
FIG. 24 is a side view of the mobile station of FIG. 23 with cooler and seat.
Figure 23:
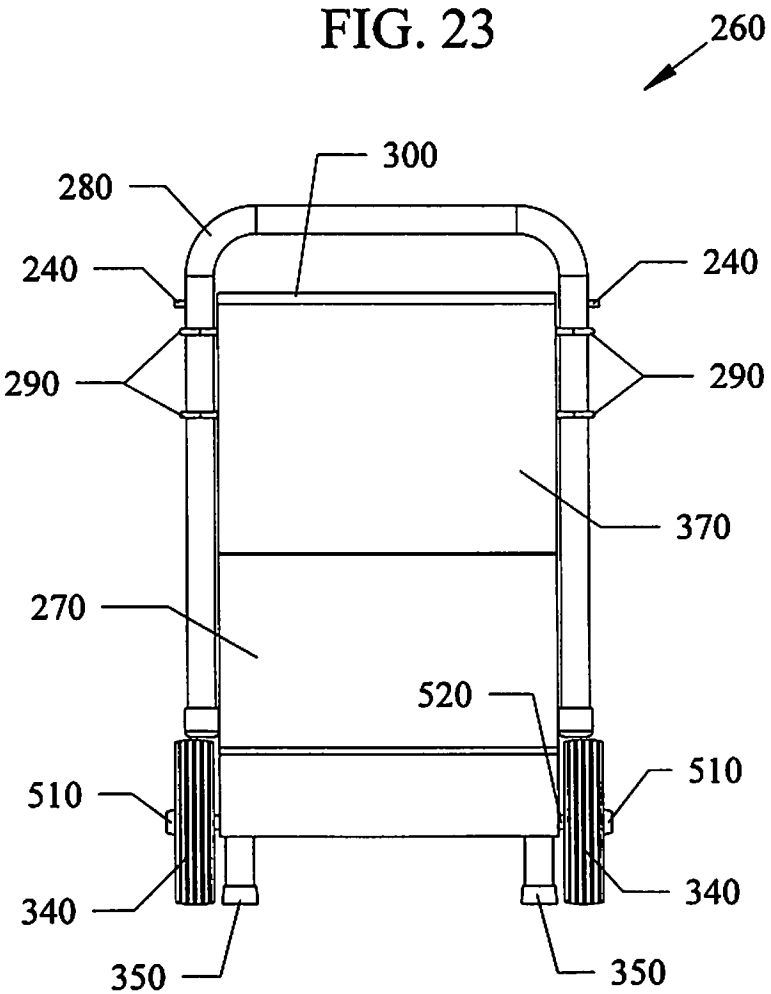
FIG. 23 is a front view of a mobile station with cooler and a seat portion on the station.
Figure 25:
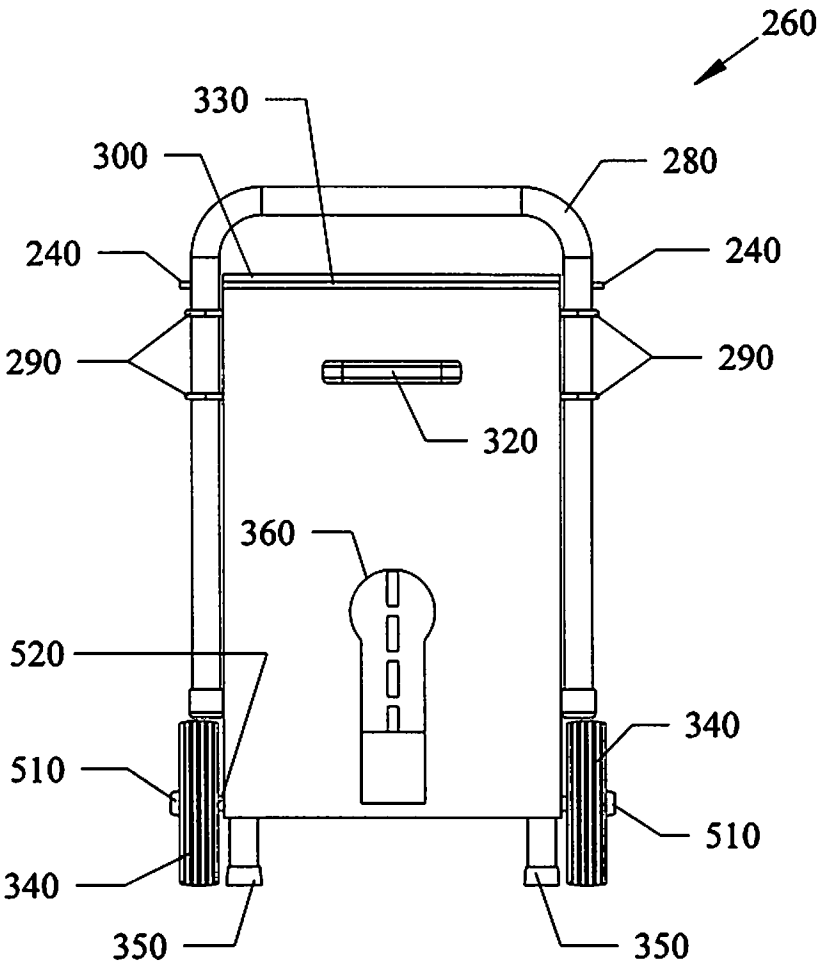
FIG. 25 is a rear view of the mobile station of FIG. 23.

FIG. 23 is a front view of a mobile station 260 with cooler 370 and cover/lid 300 which also can function as a seat. FIG. 24 is a side view of the mobile station of FIG. 23 with cooler 370 and seat cover/lid 300. FIG. 25 is a rear view of the mobile station 260 of FIG. 23.

Referring to FIGS. 23-25, the mobile station 260 can have a generally rectangular upright box shape 265 with an upper portion 370 having a cooler installed therein, and a lower wheel game portion that is accessible by a pivotable ramp 270. The lower rear of the box 265 of the mobile station can have a pair of wheels 340 attached by to ends of an axle 520 and held in place by wheel retaining caps 510. The wheel retaining caps 510 can be any type of fastener, such as but not limited to a wing nut, or another style of hand tightened fasteners.

In FIGS. 23-24, a ramp portion 270 can be pivotally attached by a hinge 275 at the bottom to a portion of the box. The ramp portion 270 can stay in a closed position by having its' top edge 278 tightly fitted into the side slot opening of the box. Other types of fasteners, such as but not limited to snaps, latches, and the like, can further hold the ramp portion in a closed position.

The sizes of the ramp and wheels can vary depending upon difficulty of play. A wheel 340 having a diameter of approximately 6 inches, would cause the ramp portion 270 to have a length (height in closed position) of approximately 7 inches, so that rolling the wheel 340 up the downward positioned ramp 270 reduces the slot opening in the box to less than approximately 7 inches.

An extendable handle 280 having an inverted U shape can be attached to the station 260 by U shaped brackets 290 that are secured to the side walls of the station box 265. Optional columns of holes 310 in the handle 280 can be used for scoring purposes with the use of optional pegs. Additionally, the handle 280 can be raised and lowered when points are achieved by the player(s). The handle 280 can be either raised or lowered to different positions during an actual game where the number of holes visible above or below the U-brackets 290 can indicate the current scores. The extendable handle 280 can be rigidly held in position by fasteners, and can be used to pull the station 260 onto wheels 340 for ease in transport.

On the back of the station 260 can be fixed handle 320 that allows for the mobile station to be moved about similar to a hand truck, where the user pulls back on the handle 260 to move the weight of the station onto the wheels 340 for transport.

Figure 27:
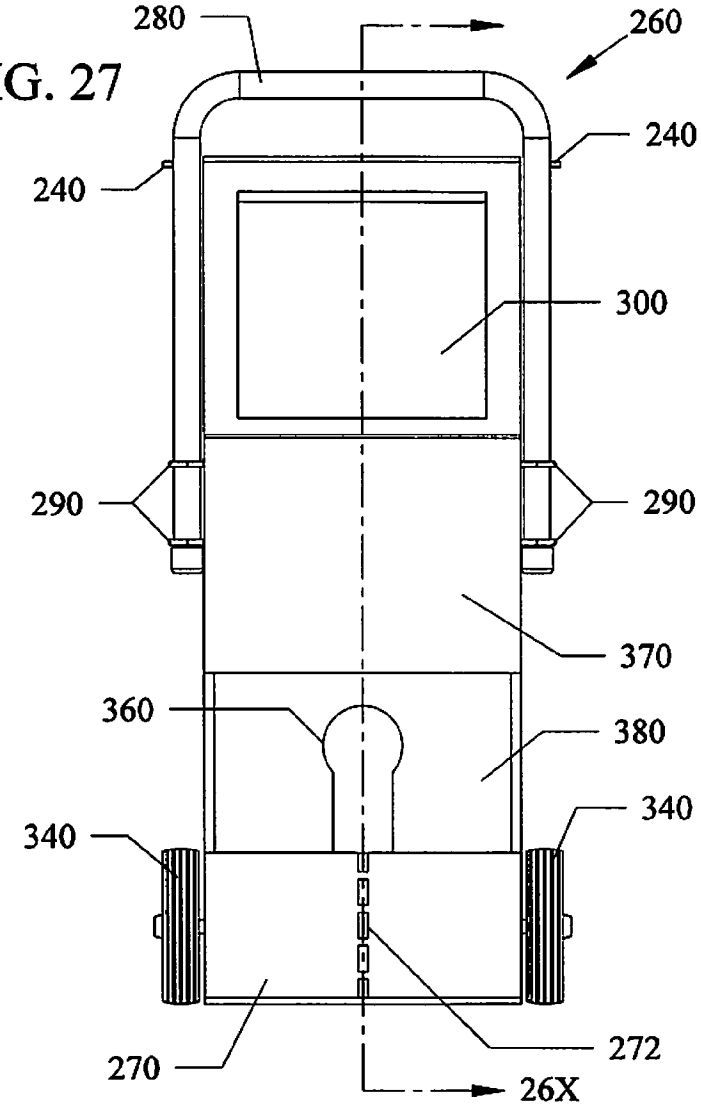
FIG. 27 is a front view of the mobile station of FIG. 25 with extendable handle up, cooler cover open, and ramp folded down for play.
Figure 26:
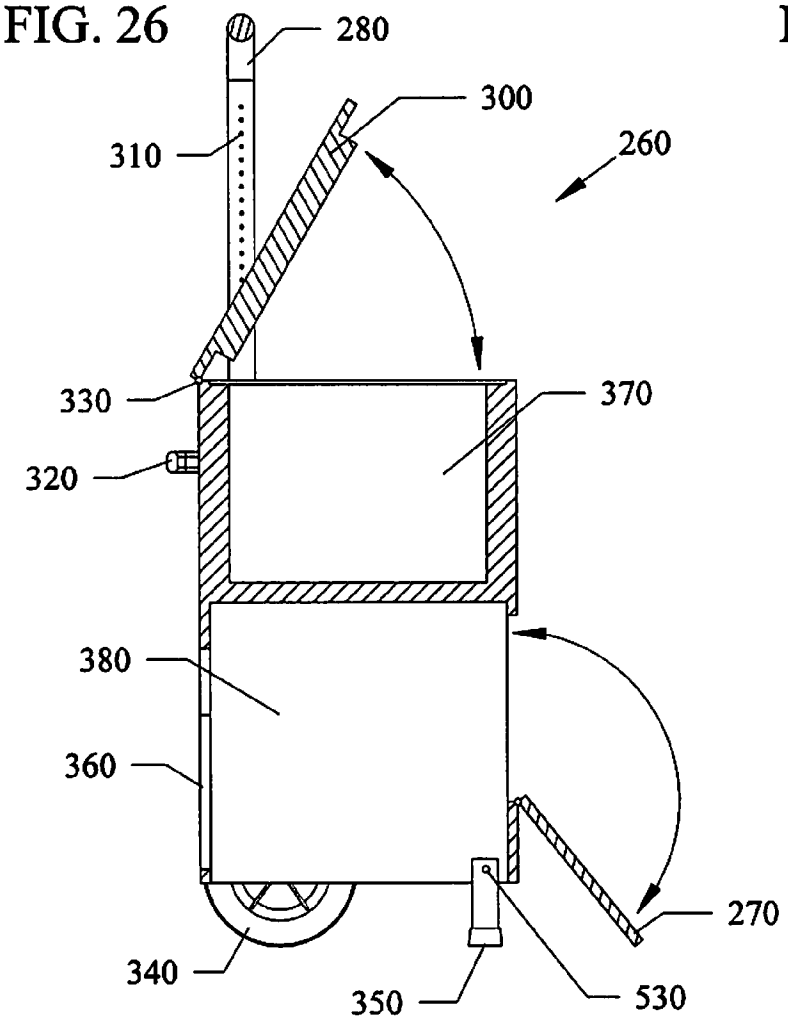
FIG. 26 is a side cross-sectional view of the mobile station of FIG. 27 along arrow 26X.

FIG. 26 is a side cross-sectional view of the mobile station 260 of FIG. 27 along arrow 26X with lid/cover 300 moved to an open position by raising the lid/cover 300 by hinge 330, which allows access to the cooler portion 370, and with ramp 270 rotated to a downward position. Handle 280 can be raised upward in play every time a score is achieved. Lower cavity 380 in the station receives the wheel 340 after it has been pitched or rolled into the station. A front side corner foot 350 is shown in the down position, which has an upper end attached to the bottom of the station 260 by a foot axle 530. During play, the foot 350 is folded up during play so that the station can sit on the ground.

FIG. 27 is a front view of the mobile station 260 of FIG. 25 with extendable handle up 280, cooler cover/lid 300 open, and ramp 270 folded down for play. In this figure peg(s) 240 are shown and can be used to indicate different scoring during the played game, where pegs can be moved into different holes when a score is achieved. A keyhole slot 360 is shown in the back of the station 260 for extra scoring potential. Down the middle of the ramp 270 can be a track indicia 272 that allows the user a target to aim at to get a rolling wheel 340 up the ramp 270 and toward the keyhole slot 360.

Figure 29:
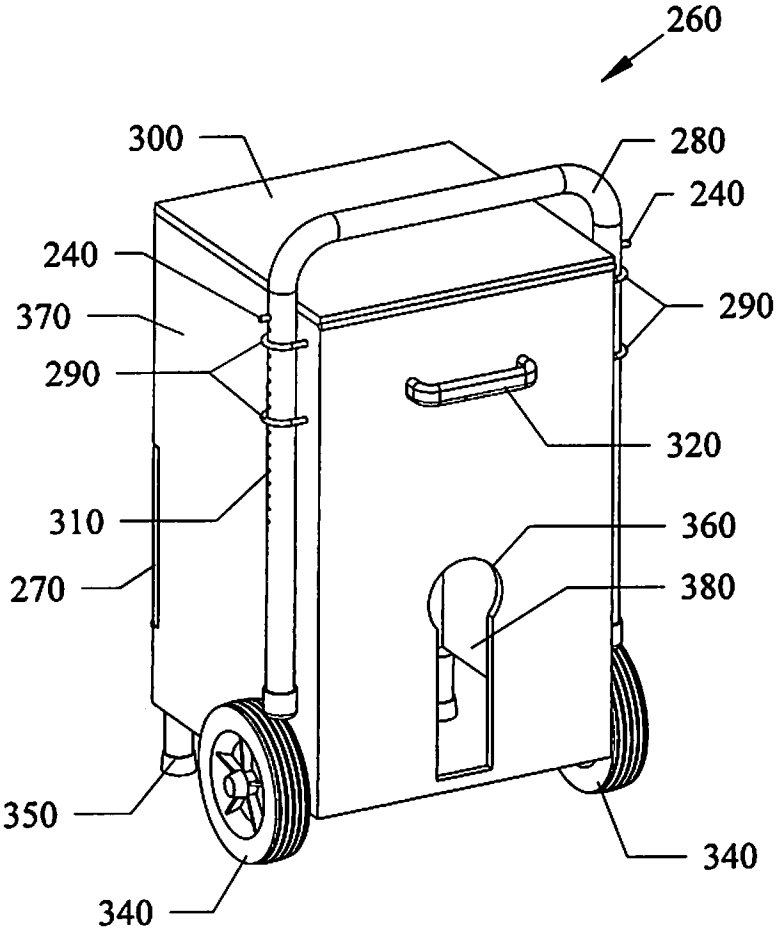
FIG. 29 is a rear perspective view of the mobile station with closed ramp of FIG. 28.
Figure 28:
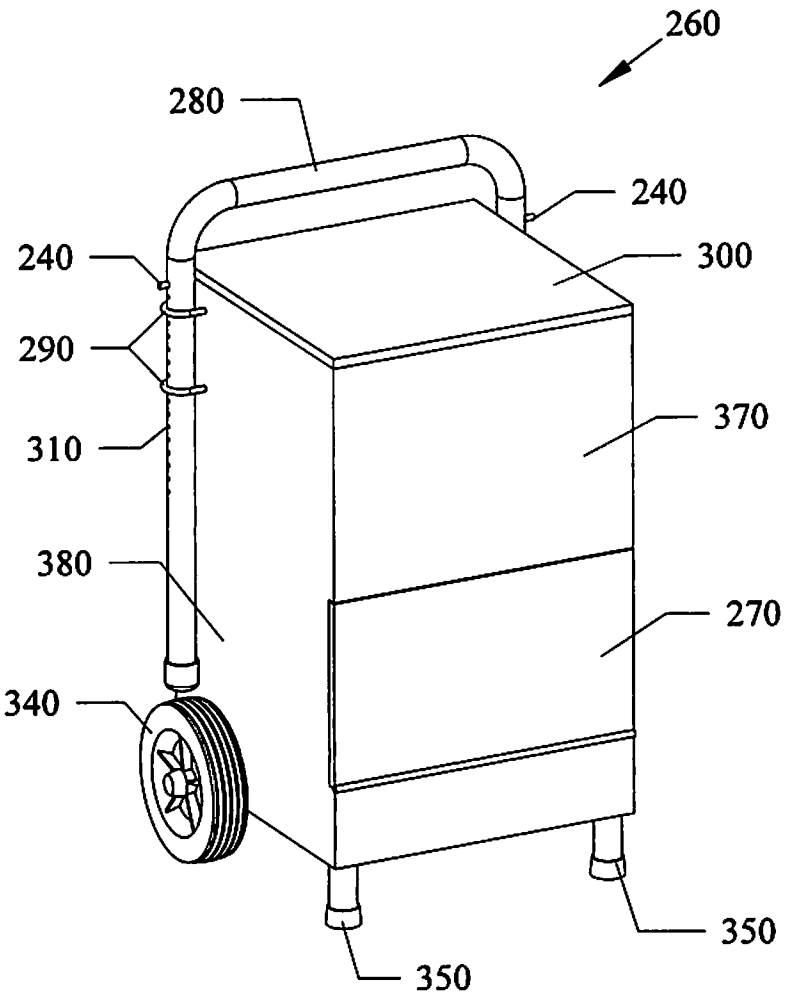
FIG. 28 is a front perspective view of the mobile station with closed ramp of FIG. 23.
Figure 30:
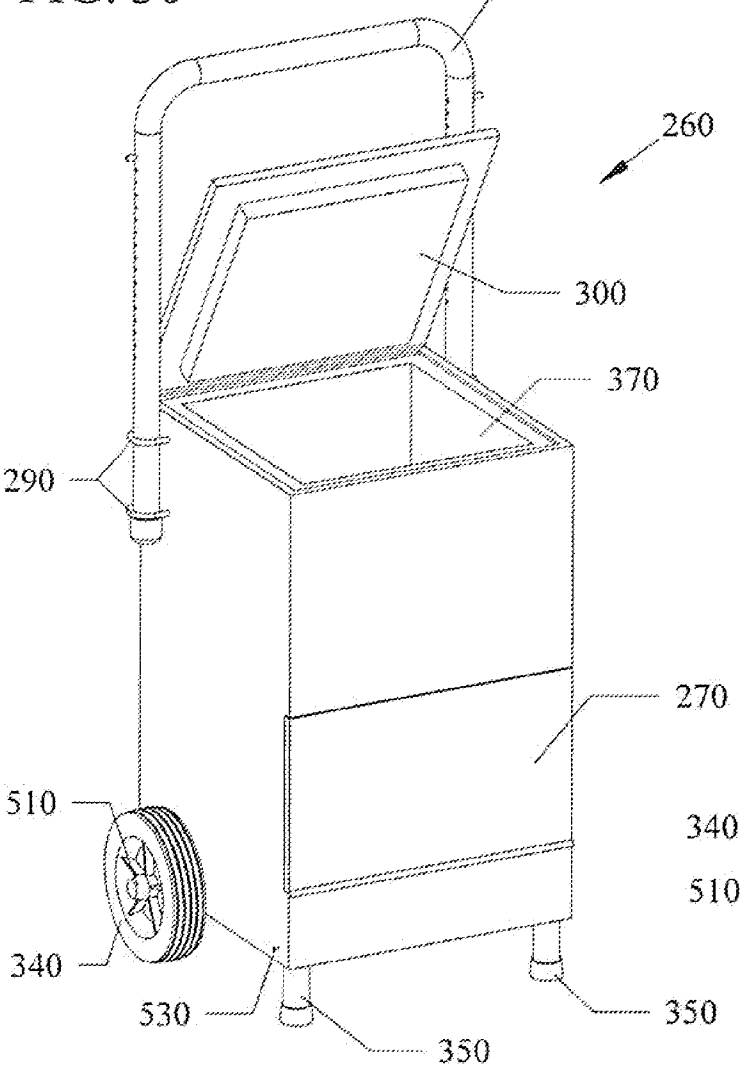
FIG. 30 is a front perspective view of the closed ramp of the station of FIG. 28 with handle extended and cooler open.

FIG. 28 is a front perspective view of the mobile station 260 with closed ramp 270 of FIG. 23 and folding feet (two foots) 350 down. FIG. 29 is a rear perspective view of the mobile station 260 of FIG. 28. FIG. 30 is a front perspective view of the mobile station 260 of FIG. 29 with ramp 270 closed, handle 280 extended and cooler cover/lid 300 open.

Figure 31:
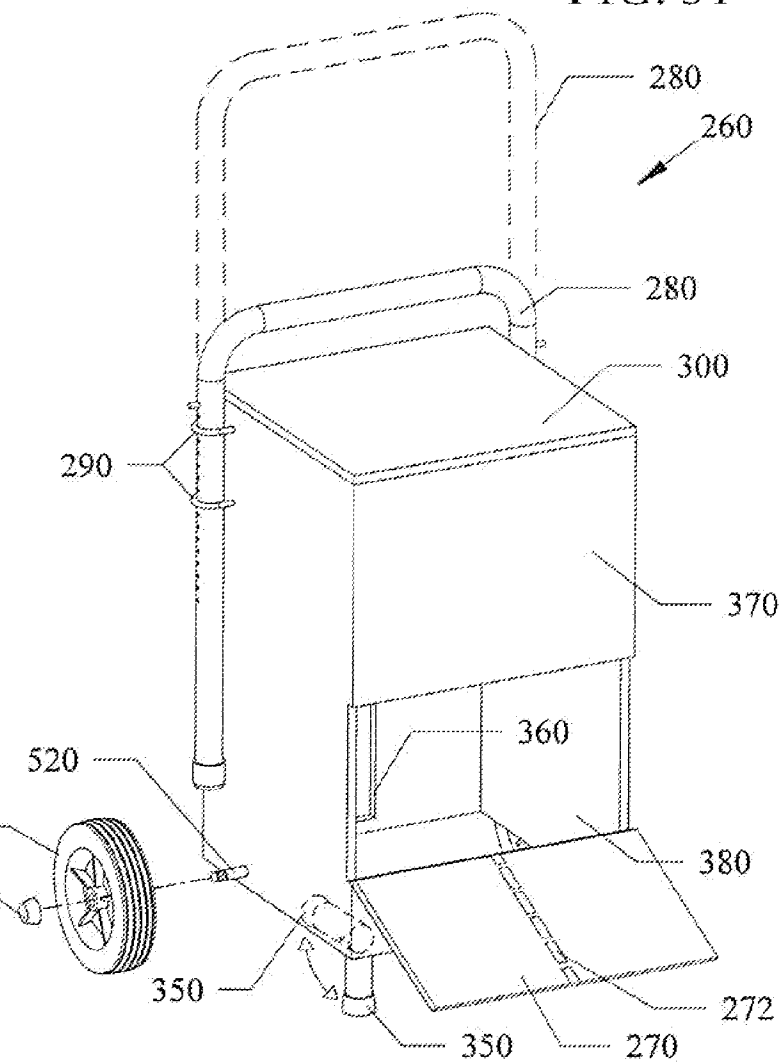
FIG. 31 is a front perspective view with the handle down, cooler closed, and ramp down for play.

FIG. 31 is a front perspective view with the handle 280 down, cooler lid/cover 300 closed, and ramp 270 down for play. Dashed lines for the handle 280 indicate the ability of the handle to extend and retract. Wheel 340 is shown removed from axle 520 by taking off cap(s) 510. Each folding foot 350 can be folded up by hinge 530 when the game is ready for play. The removed wheel(s) 340 are useable by the player(s) during the game, while the station 260 is sitting directly on the ground. After playing the game, each front foot 350 can be folded down, the wheels 340 attached to the axles 520, which allows the station 260 to be easily moved.

Figures 32, 33, 34:
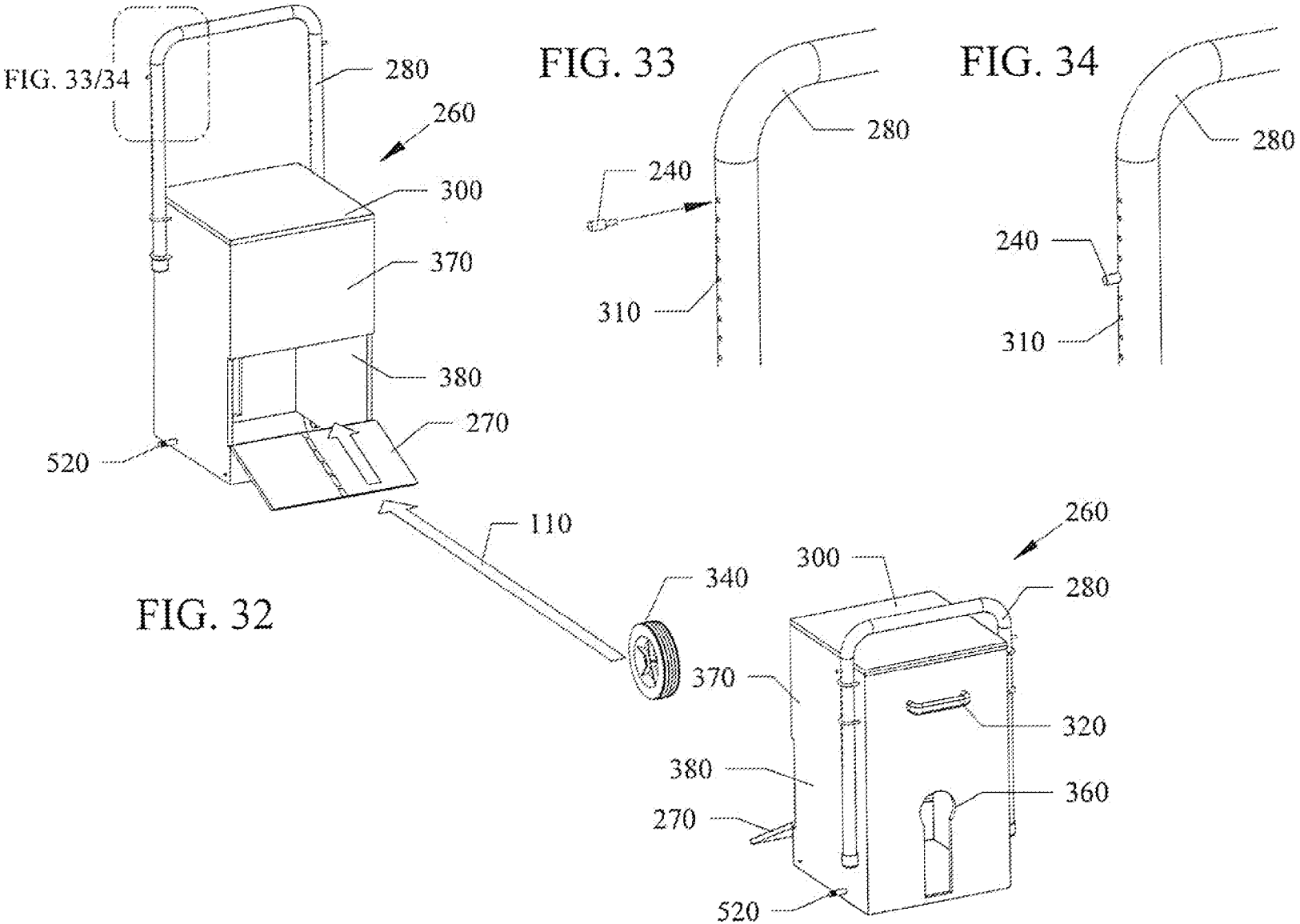
FIG. 32 is a front perspective view showing stations set up for play with the wheels removed and the folding feet folded up. The path of wheel onto the ramp and into the station is shown.
FIG. 33 is an enlarged view of the upper corner of the station of FIG. 32 with scoring holes and pegs.
FIG. 34 is another enlarged view of the upper corner of the station of FIG. 22 with scoring holes and pegs.

FIG. 32 is a front perspective view showing stations 260 set up for play with the wheels 340 removed and each foot folded inside of the lower part of the station 260. The path 110 of wheel 340 onto the ramp 270 and into the station 260 is shown. FIG. 33 is an enlarged view of the upper corner of the station 260 of FIG. 32 with scoring holes 310 and scoring peg 240. FIG. 34 is another enlarged view of the upper corner of the station 260 of FIG. 22 with scoring holes 310 and peg 240 moved to a different hole.

Portable Folding Ramp

Figure 36:
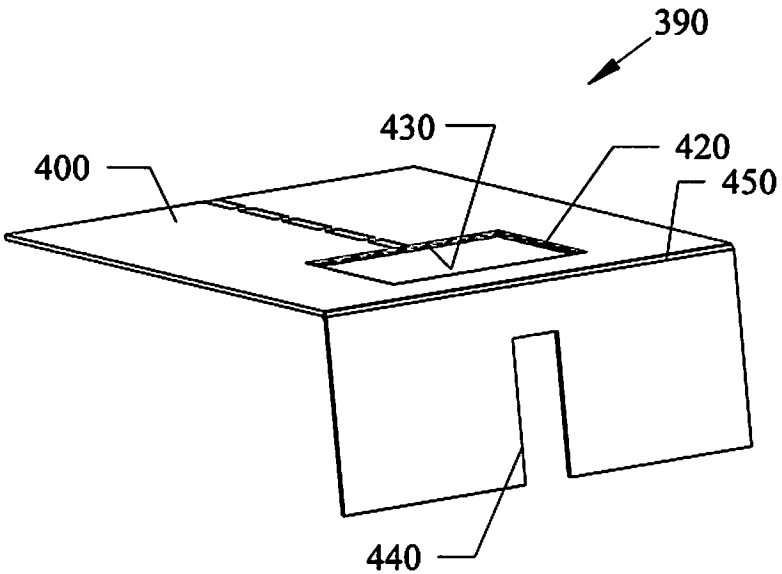
FIG. 36 is a rear perspective view of the FIG. 35 folding ramp.
Figure 35:
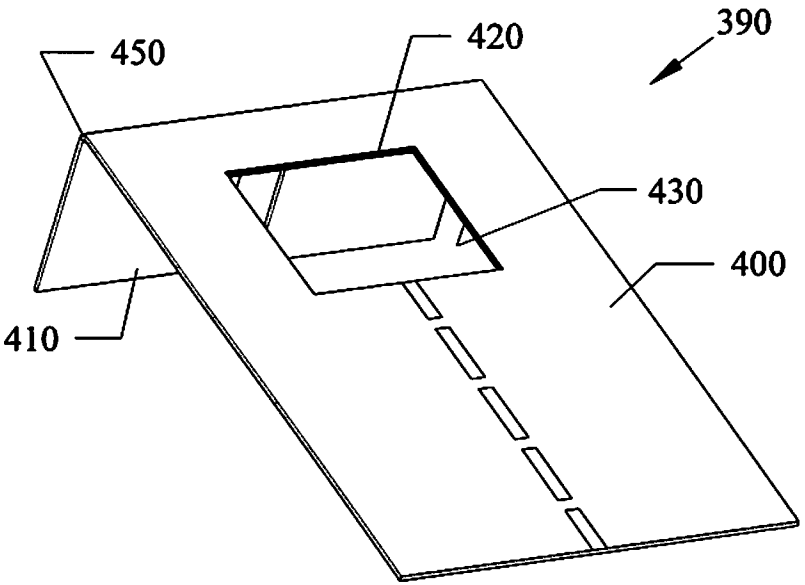
FIG. 35 is a front perspective view of the portable folding ramp version of the wheels with holes invention.
Figure 39:
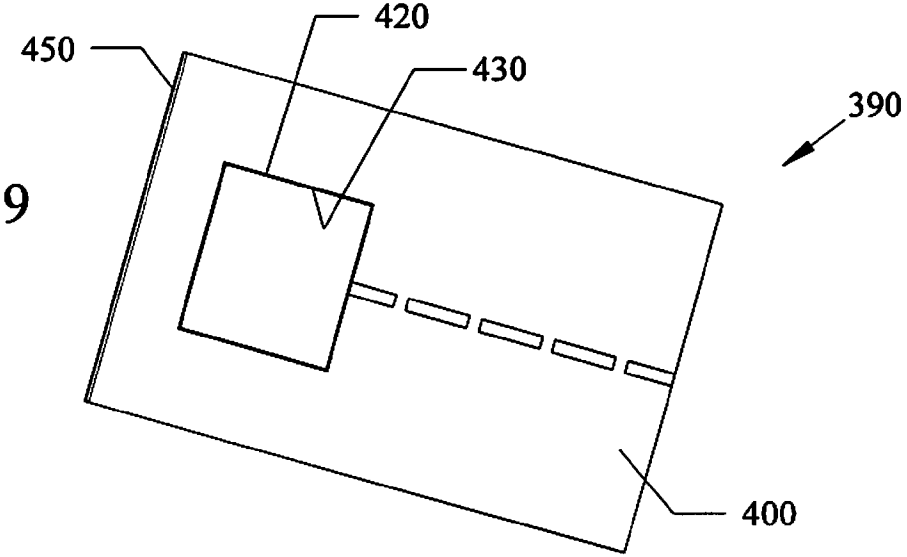
FIG. 39 is top view of the FIG. 35 folding ramp.
Figure 37:
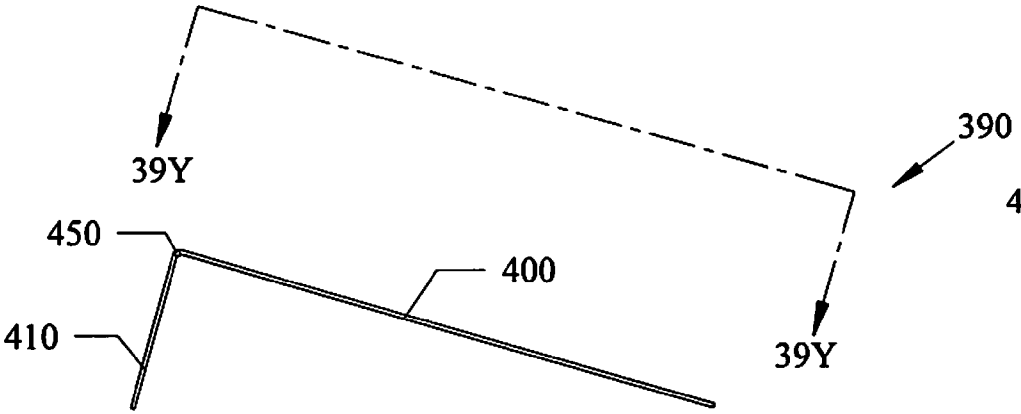
FIG. 37 is a side view of the FIG. 35 folding ramp.
Figure 38:
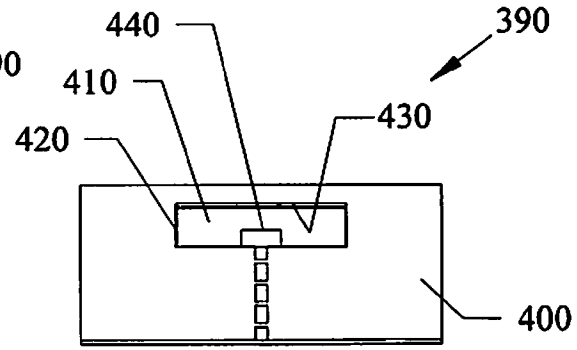
FIG. 38 is a front view of the FIG. 35 folding ramp.
Figure 40:
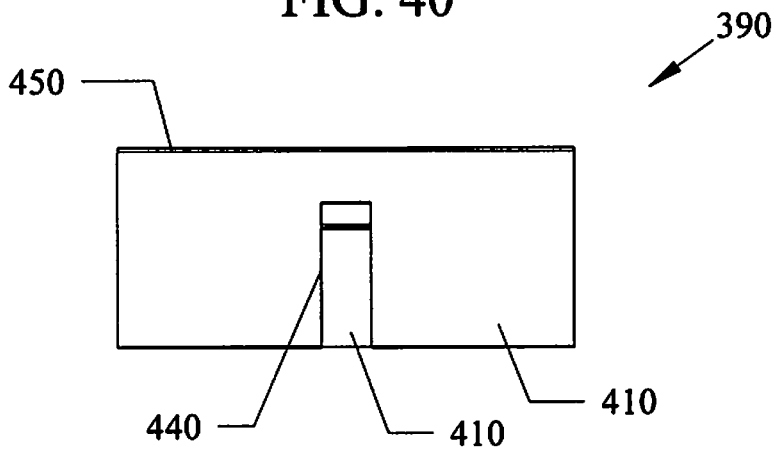
FIG. 40 is a back view of the FIG. 35 folding ramp.
Figure 41:
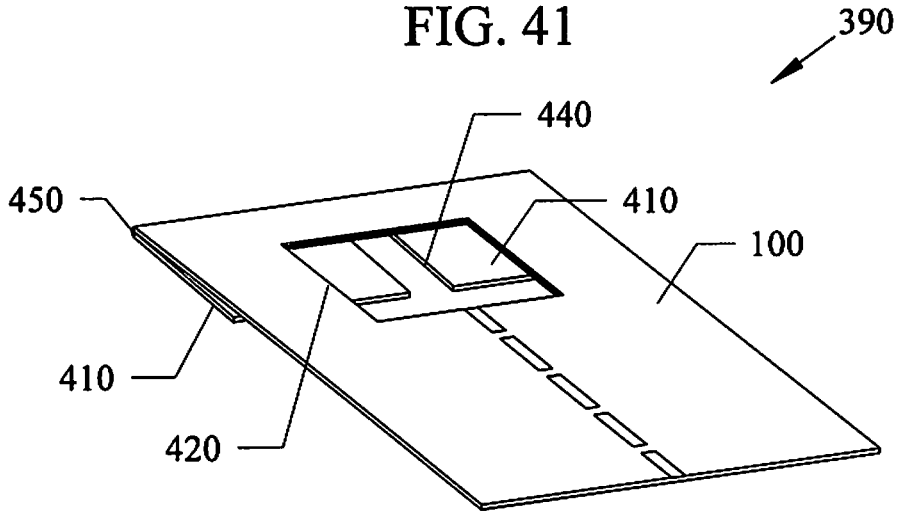
FIG. 41 is a perspective view of the FIG. 35 folding ramp.
Figure 42:
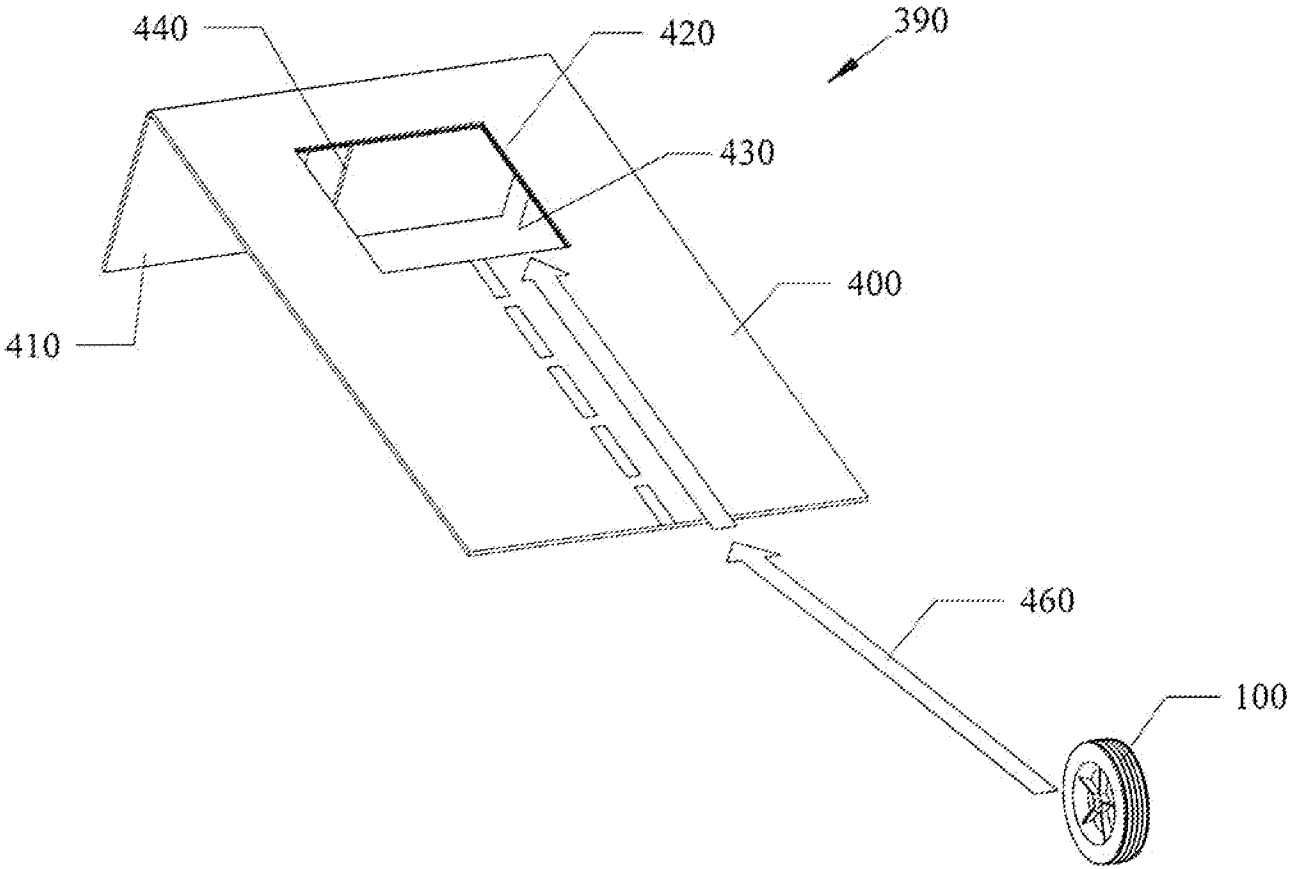
FIG. 42 is a front perspective view of the FIG. 35 folding ramp showing path of wheel up ramp and into the hole.

FIG. 35 is a front perspective view of the portable folding ramp version 390 of the wheels with holes invention. This is very much like the popular game "Corn Hole" in which a bean bag is thrown into a round hole in a similar ramp setup. FIG. 36 is a rear perspective view of the FIG. 35 folding ramp. FIG. 37 is a side view of the FIG. 35 folding ramp version 390. FIG. 38 is a front view of the FIG. 35 folding ramp 390. FIG. 39 is top view of the FIG. 35 folding ramp version 390. FIG. 40 is a back view of the FIG. 35 folding ramp. FIG. 41 is a perspective view of the FIG. 35 folding ramp version 390. FIG. 42 is a front perspective view of the FIG. 35 folding ramp 400 showing path of a wheel 460 up the ramp 490 trying to aim for track indicia 402 and into the hole 430.

Referring to FIGS. 35-42, the folding ramp version can include a main ramp 400 that having track indicia 402 thereon. Ramp 400 hinged at an upper end by a hinge 450 to a hinged support panel 410, which allows for the ramp 400 to be tilted at different degrees for different levels of play. When not being used, the support panel 410 is folded against ramp 400 allowing ease in transport and reduced space needs for storage.

A hole 420 in the ramp 400 can have a geometrical shape, such as but not limited to a rectangle, a circle, a triangle, and the like. The support panel 410 can have a keyhole shape cut-out 440 which offers extra scoring potential during the game play. Along the edges of the opening 420 can be a ledge 430 which is able to accept inserts that can change the geometry of the opening 440 to add more difficulty during wheel 100 rolling play. The wheel 100 can be rolled along path 460 to the ramp 400 similar to the previous embodiments.

Figure 44:
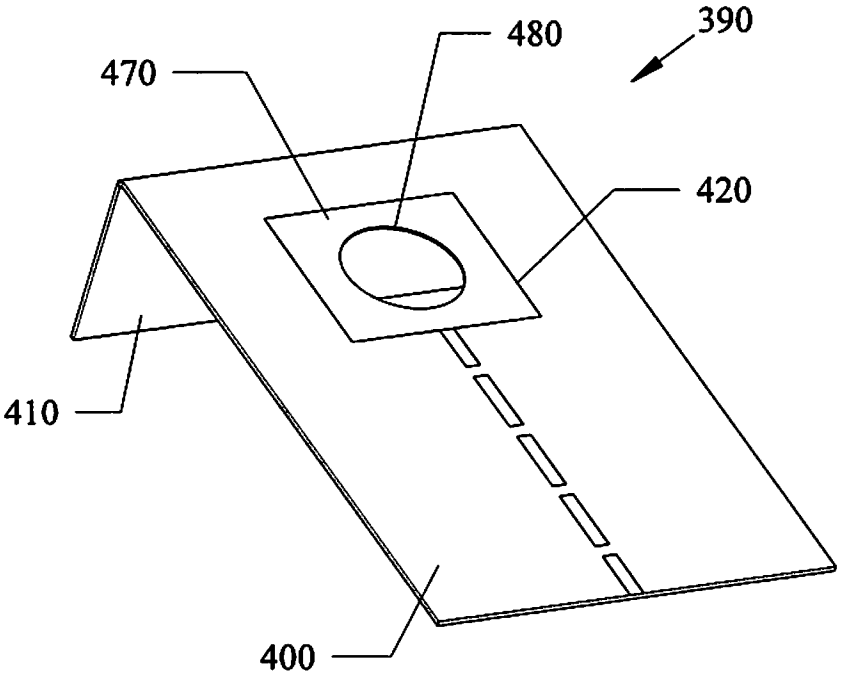
FIG. 44 is a perspective view of the FIG. 43 ramp with Corn Hole insert installed for conversion to Corn Hole play.
Figure 43:
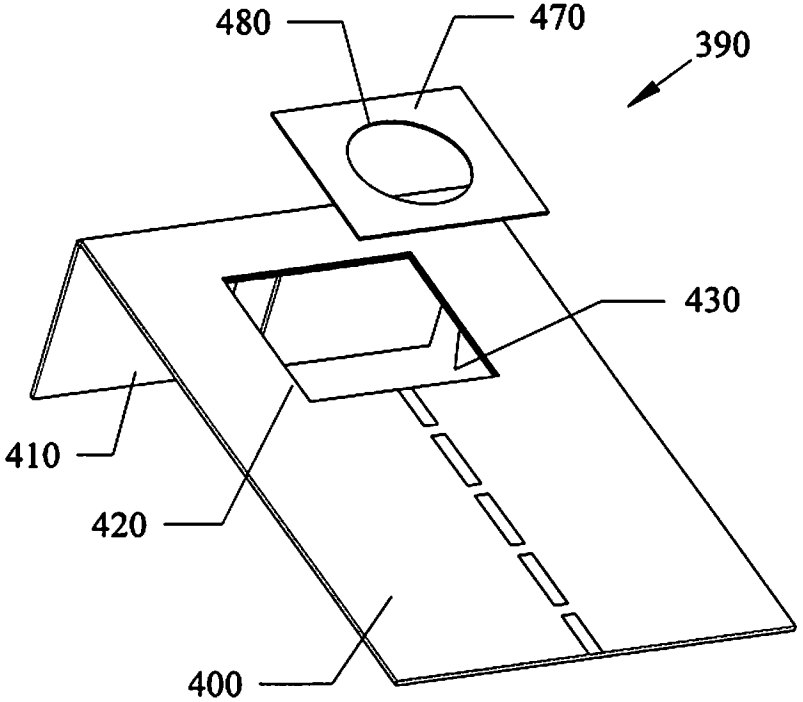
FIG. 43 is an exploded view of the ramp of FIG. 35 with Corn Hole insert ready for installation into the hole in ramp.
Figure 45:
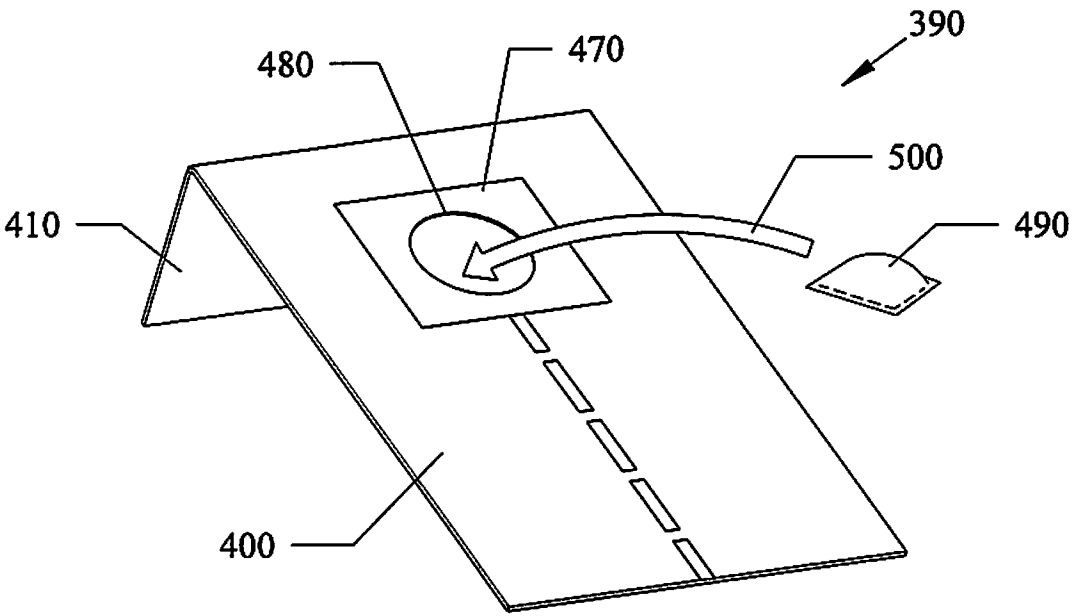
FIG. 45 is a perspective view of the Corn Hole converted ramp showing path of a bean bag into the converted game.

In addition, the ledge 430 around the perimeter of hole 440 can be used to convert the rolling wheel game to the popular corn hole bean bag game. FIG. 43 is an exploded view of the ramp version 390 of FIG. 35 with insert 470 ready for installation into the hole 420 in the ramp 400. The edges of the insert 470 are sized to fit on the ledge 430 of the hole 420. FIG. 44 is a perspective view of the FIG. 43 ramp version with insert 470 installed for conversion to Corn Hole play where bean bags can be used instead of wheels. FIG. 45 is a perspective view of the Corn Hole converted ramp 400 showing path 500 of a bean bag 490 into the converted game, where the hole is a bean bag target hole 480.

The insert 470 can also be used with the slot openings in the previous versions described above, to modify levels of skill and play difficulty.

Descriptions of playing the rolling wheel hole games will now be described.

Official Wheel Hole Playing Rules 2 or 4 players (Can be played with only 1 player for practice or self-challenge)

Wheel Hole's ramps and assemblies can have identical dimensions to insure consistency and fairness. During play, the assemblies should face each other and be separated by the desired distance. The lowest edge of the inclining ramp is also the edge of the perceived foot foul line.

Distance can be measured between foot foul edges of the Wheel Hole ramps.

Pre-measured string or a measuring tape, along with pegs and/or anchors can be used to keep accurate distance between Wheel Holes. Wheels should stay put where they fall.

The following distances in Table 1 can be used for hard surface play such as asphalt, cement or wood:

TABLE 1

| DISTANCE | AGE |
|---|---|
| 15 Feet | 8-12 years |
| 18 Feet | 13 and older |
| 20 Feet | Tournament play |

The following distances in Table 2 can be used for average yard surfaces such as grass or dirt.

TABLE 2

| DISTANCE | AGE |
|---|---|
| 12 Feet | 8-12 years |
| 15 Feet | 13 and older |
| 18 Feet | Tournament play |

The following distances in Table 3 can be used for play in soft sand or at the beach.

TABLE 3

| DISTANCE | AGE |
|---|---|
| 5 Feet | 8-12 years |
| 8 Feet | 13 and older |
| 10 Feet | Tournament play |

In doubles, team partners face can each other from opposite Wheel Hole assemblies.

Each team can play with 2 wheels. If a wheel rolls at least ½ way back, roll it again.

Opponents can alternate turns until all wheels are rolled.

For example, the round is then scores (See Game Scoring Rules). The team with the highest score rolls first. Also, the team that ties the score, rolls first. The winning team rolls first at the starting of the next game. Opponents may call a foot foul and the call must be honored. Alternate rolling sides and R/L positions after each game Game Scoring Rules:

Winner can be the first player or team to acquire 21 points or more 1 point can be scored for the $1^{st}$ wheel rolled into the Wheel Hole target area.

2 points can be scored for the $2^{nd}$ wheel rolled in by either team.

3 points can be scored for the $3^{rd}$ wheel rolled in by either team.

4 points can be scored for the $4^{th}$ wheel rolled in by either team.

5 points can be scored for a wheel rolled through the Wheel Hole at any times, by it doesn't count as a wheel rolled in for added points.

Playing examples will now be described.

Example 1

Red Team rolls first wheel in for 1 point

Blue Team rolls in the next wheel ($2^{nd}$) for 2 points

Red Team misses next roll

Blue Ream rolls in next wheel ($3^{rd}$) for 3 points SCORE: Red Team=1, Blue Team=5

Example 2

Blue Team rolls first, and in for 1 point

Red Team rolls a Wheel Hole through for 5 points

Blue Team rolls next wheel in ($2^{nd}$) for 2 points

Red Team rolls next wheel in ($3^{rd}$) for 3 points

SCORE: Red Team=8, Blue Team=3.

If Example 1 and 2 team SCORES are added together, Red Team=9, Blue Team=8, then the Red Team rolls first, starting the next round. If a foot foul is called on either team, that wheel is disqualified from all scoring.

Game Set-Up

For location, any surface will suffice but a reasonably level playing area should be preferred.

Playing area should be approximately 10 feet wide and 30 feet long. Participants nearest the target Wheel Hole should stop long-rolled wheels with their foot, once they pass the back edge.

If playing in sand, the distance between Wheel Holes should be no more than 10 feet and the forward roll should be used instead of the backspin technique.

The Lingo for the Game

Roller—Players/participants

High Roller(s)—the player or team with the highest or tying score, or winner(s) of the previous game. High Roller would roll first in the next round or to begin the next game.

The Dog House—another name for the target area.

Grey Hound—a wheel rolled too fast and/or too far.

Fender Bender—when the wheel is rolled too hard and bounces back off the target.

Blood Hound—a wheel rolled too slow and/or not far enough which makes it land in . . . .

The Bone Yard—the playing area between both ramps where the wheels fall and stop.

The Bone—any wheel blocking the path of a roller

Lucky Dog—when the wheel comes at least % way back towards the roller. A re-roll is awarded.

The Dog—any wheel, anywhere on the playing surface where it lands.

Run Over the Dog—any wheel that rolls over another wheel on the playing field.

Prairie Dog—when the wheel doesn't go all the way through the cut-out hole in back.

Wheel Hole—when the wheel drops into the target area and totally out of the cut-out.

Wee Ho! Or Wheel Ho!—shouted out when the player rolls a Wheel Hole.

The Stance and Roll

Players can stand upright and behind or to the side of the game assembly when using the back spin roll. Player(s) can also sit on the station boxes during play or at rest. To start, each player can hold the wheel with their thumb and fore-fingers of one hand and loft it with a forward and up flick of the wrist, to within a few feet from the target area, so it lands and rolls forward and straight at a reasonable speed.

To employ the forward roll, players can cup the bottom section of the wheel in your palm, with your fore-fingers extended along the bottom part of the wheel, pointing forward. Players can stand on either side of the Wheel Hold assembly, slightly bent over at the hips to roll and release the wheel low and forward, off your fingers, similar to bowling.

PROGRESSIVE SCORING or UNDERDOG SCORING—favors the person/team with the lower score.

Whether playing singles or doubles, one round is complete after 4 wheels are rolled.

In Singles:

Each player stands behind, or sits on the opponents target. Each player can start with 2 wheels. The first wheel is always rolled by the winner of the previous game or the defending champion. If no prior game was played and there is not a determined champion to roll, a coin toss is appropriate to get started.

Points cam be accumulated by the progression of wheels successfully rolled into either of the Wheel Hole target areas. First wheel in, regardless of who rolls it or which target it is, garners 1 point, second wheel in garners 2 points. Third wheel in garners 3 points and forth wheel in garners 4 points. If a wheel goes all the way through the cut out in the back, 5 points is awarded to that roller but it doesn't count as a wheel in.

Example: players are standing for this example

Player A stands behind Wheel Hole™ station box B. Twenty feet away is Player D standing behind Wheel Hole™ station box C.

Player A|Wheel Hole™ station box B _____20 '_____Wheel Hole™ station box C|Player D Player A rolls first wheel and misses Wheel Hole™ station box C—00 points.

Player D rolls next and the first wheel goes into Wheel Hole™ station box B—01 point (first wheel in).

Player A rolls his/her last wheel into Wheel Hole™ station box C—02 points (second wheel in).

Player D rolls his/her last wheel into Wheel Hole™ station box B—03 points (third wheel in).

*One round of play is complete. Player D has 4 points, player A has 2 points.

Player D rolls first wheel into Wheel Hole™ station box B —01 point (first in)—now has 5 points total.

Player A rolls next and his/her wheel goes into Wheel Hole™ station box C—02 points (second in) now has 4 points.

Player D rolls his/her last wheel into Wheel Hole™ station box B—03 points (third in)—now has 8 points total.

Player A rolls his/her last wheel into Wheel Hole™ station box C—04 points (4th In)—now has 8 points total.

*Second round is over Player D and Player A are tied at 8 points. Now Player A rolls first in next round.

FIRST one to reach 21 points is the winner of that game regardless of how many wheels remain. The winner then rolls the first wheel to starts the next round.

In Doubles:

Player A & Player E stand behind Wheel Hole™ station box B.

Twenty feet away, Player D and Player F stand behind Wheel Hole™ station box C.

Player A and Player F are partners. Player D and Player E are partners.

Each opposing player standing on one side starts with 2 wheels. The first wheel is always rolled by one of the winners of the previous game or the defending champion team. If no prior game was played and there is no determined champions to roll, a coin toss is appropriate to get started.

The scoring can be accumulated in the same manner as in singles, but the players are rolling towards the same Wheel Hole target taking alternating turns, beginning with the team that has the highest score or the team that has just tied the score. All four wheels can be rolled to end the round. The wheels will then be rolled back in the other direction starting with the team player that has the highest score or just tied the score from the previous round. Continue back and forth until a team reaches 21 points to win.

After a roll, if the wheel rolls back at least half way towards the original roller, he/she gets to roll that wheel again. Otherwise, the wheels can remain where they fall, even if it is blocking the path or ramp. Wheels that are obviously going to miss the target should be stopped by the closest player's foot so the wheel will not keep rolling past.

Degree of Difficulty

Difficulty level can be increased or decreased by changing the distance between Wheel Hole™ station box targets.

*5 point Wheel Hole™ station box (through the back) can be made more easily by changing the width of the cut-out.

The invention components can be formed from various types of materials, such as but not limited to plastic, fiberglass, wood, and the like.

Although the slot described in the back of the box or rear panel is described as keyhole shaped, the slot shape can vary to any geometrical shape or configuration.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A portable wheel rolling game box, comprising:
a top cover and two opposing side panels;
a front side panel with a foldable ramp portion;
a rear side panel having a target; and
at least one wheel to roll up the ramp to the target.

2. The portable wheel rolling game box of claim 1, further comprising: a removable bottom cover to close off the box.

3. The portable wheel rolling game box of claim 2, wherein the box includes: latches for closing the top cover to the bottom cover when the box has been disassembled and compacted into a carryable suit case.

4. The portable wheel rolling game box of claim 2, further comprising a second box comprising:
a second set of two opposing side panels;
a second front side panel with ramp portion;
a second rear side panel having a second target; and
at least one additional wheel for being rollable up the second ramp and toward the second target.

5. The portable wheel rolling game box of claim 4, wherein the box includes: axle portions for attaching each of the wheels thereto when the game is not being played.

6. The portable wheel rolling game box of claim 4, wherein the box includes: latches for closing the top cover to the bottom cover when the box has been disassembled and compacted into a carryable suit case.

7. The portable wheel rolling game box of claim 1, wherein the at least one wheel includes two wheels.

8. The portable wheel rolling game box of claim 7, wherein the box includes: axle portions for attaching each of the wheels thereto when the game is not being played.

9. The portable wheel rolling game box of claim 7, further comprising: a lift handle on the back of the box so as to transport the box by tilting the box and pulling on the lift handle so that the box rolls on the wheels.

10. The portable wheel rolling game box of claim 9, further comprising a hinged lid on top of the box for allowing access into the upper cooler compartment.

11. The portable wheel rolling game box of claim 8, further comprising an upper compartment for housing a cooler.

12. The portable wheel rolling game box of claim 11, further comprising: foldable pegs underneath a front corners of the bottom cover of the box, wherein the axle portions are on the rear corners of the bottom cover of the box, the pegs being foldable upward when the wheels are removed so that the bottom of the box rests on the ground.

13. The portable wheel rolling game box of claim 1, wherein the wheel includes; a rim with a tire about a perimeter of the rim, and at least one removable hub panel for indicia.

14. The portable wheel rolling game box of claim 1, further comprising: holes in the box and removable pegs for keeping score during a game.

15. The portable wheel rolling game box of claim 1, further comprising: a raiseable and lowerable handle having slots which when exposed during the raising and lowering of the handle keep score during the game.

16. A foldable ramp for games, comprising:

a rear panel;

a ramp panel having a rear edge;

a hinge for allowing the rear panel to fold against or fold outward from the ramp panel;

a target opening in the ramp panel, wherein the ramp panel is adapted be raised to an angle with the rear panel folded outward for playing a game; and a removable insert for the target opening to change the dimensions of the target opening to different size openings.

17. A foldable ramp for games, comprising:

a rear panel;

a ramp panel having a rear edge;

a hinge for allowing the rear panel to fold against or fold outward from the ramp panel; and a target opening in the ramp panel, wherein the ramp panel is adapted be raised to an angle with the rear panel folded outward for playing a game; and a slot in the rear panel to increase play difficulty.

* * * * *